US008085282B2

(12) United States Patent
Sagano et al.

(10) Patent No.: US 8,085,282 B2
(45) Date of Patent: Dec. 27, 2011

(54) IMAGE DISPLAY APPARATUS AND DRIVING METHOD OF IMAGE DISPLAY APPARATUS

(75) Inventors: Osamu Sagano, Inagi (JP); Kohei Inamura, Sagamihara (JP); Naoto Abe, Machida (JP); Hiroshi Saito, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 1054 days.

(21) Appl. No.: 11/951,776

(22) Filed: Dec. 6, 2007

(65) Prior Publication Data

US 2008/0150969 A1 Jun. 26, 2008

(30) Foreign Application Priority Data

Dec. 13, 2006 (JP) ..... 2006-335839
Dec. 3, 2007 (JP) ..... 2007-312167

(51) Int. Cl.
*G09G 5/10* (2006.01)

(52) U.S. Cl. ..... 345/690; 345/204; 345/75.1

(58) Field of Classification Search ..... 345/74.1, 345/75.1, 87–90, 208, 204, 690
See application file for complete search history.

(56) References Cited

U.S. PATENT DOCUMENTS

| | | | | |
|---|---|---|---|---|
| 5,659,328 | A | 8/1997 | Todokoro et al. | |
| 5,734,361 | A | 3/1998 | Suzuki et al. | |
| 6,140,985 | A | 10/2000 | Kanai et al. | 345/74 |
| 6,515,641 | B1 | 2/2003 | Sagano et al. | 345/76 |
| 6,552,702 | B1 | 4/2003 | Abe et al. | 345/75.2 |
| 6,603,450 | B1 | 8/2003 | Yamazaki et al. | 345/75.2 |
| 6,707,437 | B1 | 3/2004 | Kuno et al. | 345/74.1 |
| 6,839,054 | B2 | 1/2005 | Abe et al. | 345/204 |
| 6,933,935 | B2 | 8/2005 | Sagano et al. | 345/204 |
| 7,009,627 | B2 | 3/2006 | Abe et al. | 345/690 |
| 7,079,161 | B2 | 4/2006 | Sagano et al. | |
| 7,154,457 | B2 | 12/2006 | Sagano et al. | 345/78 |
| 7,180,514 | B2 | 2/2007 | Kuno et al. | 345/211 |
| 7,205,987 | B2 | 4/2007 | Sagano et al. | 345/204 |
| 7,227,521 | B2 | 6/2007 | Yamazaki et al. | 345/84 |
| 7,268,751 | B2 | 9/2007 | Yamazaki et al. | 345/76 |
| 7,307,606 | B1 | 12/2007 | Yamazaki et al. | 345/77 |
| 2003/0006976 | A1 | 1/2003 | Sagano et al. | |
| 2003/0030654 | A1 | 2/2003 | Sagano et al. | |
| 2004/0165004 | A1 | 8/2004 | Sagano et al. | 345/691 |
| 2004/0246277 | A1 | 12/2004 | Abe et al. | 346/690 |
| 2004/0257311 | A1 | 12/2004 | Kanai et al. | |
| 2005/0078051 | A1 | 4/2005 | Abe et al. | 345/1.1 |
| 2006/0256142 | A1 | 11/2006 | Sagano et al. | 345/690 |
| 2007/0085777 | A1 | 4/2007 | Kuno et al. | 345/74.1 |
| 2007/0139302 | A1 | 6/2007 | Yamazaki et al. | 345/58 |

FOREIGN PATENT DOCUMENTS

| | | |
|---|---|---|
| JP | 2-257553 | 10/1990 |
| JP | 7-181911 | 7/1995 |
| JP | 8-248920 | 9/1996 |
| JP | 2003-223131 | 8/2003 |
| JP | 2003-233344 | 8/2003 |
| JP | 2005-31636 | 2/2005 |

*Primary Examiner* — Amare Mengistu
*Assistant Examiner* — Hong Zhou
(74) *Attorney, Agent, or Firm* — Fitzpatrick, Cella, Harper & Scinto

(57) ABSTRACT

There is provided an image display apparatus including: a first correction unit for outputting data to determine a lighting time of a first pixel on the basis of data to indicate luminance of the first pixel, wherein the first correction unit carries out first correction to compensate a loss of the luminance of the first pixel; and a second correction unit for outputting data to determine a lighting time of a second pixel on the basis of data to indicate luminance of the second pixel, wherein the second correction unit carries out second correction to compensate a loss of the luminance of the second pixel by predicting a lighting state of the first pixel that is corrected by the first correction.

12 Claims, 13 Drawing Sheets

$$C1=((Xn+1-x)*CA+(x-Xn)*CB)/(Xn+1-Xn)$$

$$C2=((Xn+1-x)*CC+(x-Xn)*CD)/(Xn+1-Xn)$$

$$DD3=C1*(Dth[k+1]-DD2)+C2*(DD2-Dth[k])/(Dth[k+1]-Dth[k])$$

FIG.12

| | BLOCK 0 | BLOCK 1 | BLOCK 2 | BLOCK 3 |
|---|---|---|---|---|
| ≧0 | 7 | 7 | 7 | 7 |
| ≧4 | 6 | 7 | 6 | 6 |
| ≧8 | 6 | 7 | 5 | 6 |
| ≧12 | 5 | 6 | 5 | 6 |
| ≧16 | 5 | 6 | 5 | 4 |
| ⋮ | ⋮ | ⋮ | ⋮ | ⋮ |
| ≧252 | 2 | 2 | 1 | 0 |
| =255 | 1 | 0 | 0 | 0 |

IMAGE DISPLAY APPARATUS AND DRIVING METHOD OF IMAGE DISPLAY APPARATUS

BACKGROUND OF THE INVENTION

1. Field of the Invention

The present invention relates to an image display apparatus and a driving method of the image display apparatus.

2. Description of the Related Art

Japanese Patent Application Laid-Open (JP-A) No. 2-257553 discloses controlling of a pulse width of a voltage to be applied to each of modulation electrodes in order to compensate variation of the amount of electron-emitting beam from each of a plurality of electron-emitting devices due to variation of a voltage to be applied to each of the plurality of electron-emitting devices.

JP-A No. 8-248920 (U.S. Pat. No. 5,734,361) discloses an image forming apparatus using electron-emitting devices that are arranged in a simple matrix. This image forming apparatus is provided with drive signal generating unit for outputting a drive pulse for driving a cold-cathode device to be connected to a selected row wiring to each of a plurality of column wirings. This drive signal generating unit outputs a drive pulse that is corrected by a correction value corresponding to each column wiring.

JP-A No. 2003-223131 (US 2003/0006976 A1; U.S. Pat. No. 7,079,161) discloses a structure providing a plurality of reference positions in row wirings in order to make hardware for calculating a correction value small and obtaining a correction value for this. In addition, this discloses that the correction value other than the reference position is obtained by interpolating the correction value that is obtained on the reference position.

SUMMARY OF THE INVENTION

In an image display apparatus, a quality of an image to be displayed is lowered if a signal loss such as a voltage drop takes place. Although there has been an attempt to prevent lowering of a quality of an image by correction, the correction at a higher degree of accuracy has been desired.

An object of the present invention is to provide an image display apparatus having improved correction accuracy.

The first aspect of the present invention provides an image display apparatus comprising:

a first pixel and a second pixel;

a common wiring to which the first pixel and the second pixel are connected in common;

a first modulation signal wiring that is connected to the first pixel and applies a modulation signal for modulating a lighting time of the first pixel;

a second modulation signal wiring that is connected to the second pixel and applies a modulation signal for modulating a lighting time of the second pixel;

a first correction unit for outputting data to determine the lighting time of the first pixel on the basis of data to indicate luminance of the first pixel, wherein the first correction unit carries out first correction to compensate a loss of the luminance of the first pixel;

a second correction unit for outputting data to determine the lighting time of the second pixel on the basis of data to indicate luminance of the second pixel, wherein the second correction unit carries out second correction to compensate a loss of the luminance of the second pixel by predicting a lighting state of the first pixel that is corrected by the first correction; and a modulation signal output circuit for outputting the modulation signal on the basis of the outputted data to determine the lighting time.

The second aspect of the present invention provides a driving method of an image display apparatus, the image display apparatus, having:

a first pixel and a second pixel;

a common wiring to which the first pixel and the second pixel are connected in common;

a first modulation signal wiring that is connected to the first pixel and applies a modulation signal for modulating a lighting time of the first pixel; and a second modulation signal wiring that is connected to the second pixel and applies a modulation signal for modulating a lighting time of the second pixel; and the driving method comprising the steps of:

outputting data to determine the lighting time of the first pixel on the basis of data to indicate luminance of the first pixel, the data to determine the lighting time of the first pixel being data to which first correction to compensate a loss of the luminance of the first pixel is applied;

outputting data to determine the lighting time of the second pixel on the basis of data to indicate luminance of the second pixel, the data to determine the lighting time of the second pixel being data to which a second correction to compensate a loss of the luminance of the second pixel by predicting a lighting state of the first pixel that is corrected by the first correction is applied; and outputting the modulation signal on the basis of the outputted data to determine the lighting time.

The third aspect of the present invention provides an image display apparatus comprising:

a plurality of pixels;

a common wiring to which the plurality of pixels are connected in common;

a plurality of modulation signal wirings, each of which is connected to each of the plurality of pixels, and applies a modulation signal for modulating a lighting time of the pixel to the pixel;

a correction circuit for correcting inputted data and outputting the corrected data; and a modulation signal output circuit for outputting the modulation signal on the basis of the data that is corrected by the correction circuit, wherein when M pieces of periods in a period that the modulation signal can be outputted are referred to as first to Mth periods, where M is defined to be a natural number and p is defined to be a natural number in $2 \leqq p \leqq M$, the correction circuit has:

a calculation unit for calculating a value representing luminance during a first period of each of the plurality of pixels on the basis of the inputted data and calculating a value representing luminance during a pth period in sequence; and an accumulation unit for accumulating the value representing the luminance during each period for each pixel; and wherein on the basis of a result of determining a pixel that the accumulated value thereof exceeds a value representing luminance that is indicated by the inputted data thereof, a value representing the luminance during the pth period is calculated.

The fourth aspect of the present invention provides a driving method of an image display apparatus, the image display apparatus, having:

a plurality of pixels;

a common wiring to which the plurality of pixels are connected in common;

a plurality of modulation signal wirings, each of which is connected to each of the plurality of pixels, and applies a modulation signal for modulating a lighting time of the pixel to the pixel;

the driving method comprising:

a correcting step for correcting inputted data; and a step of outputting the modulation signal on the basis of the data that is corrected by the correction step, wherein when M pieces of periods in a period that the modulation signal can be outputted are referred to as first to Mth periods, where M is defined to be a natural number and p is defined to be a natural number in $2 \leqq p \leqq M$, the correction step includes:

a step for calculating a value representing luminance during a first period of each of the plurality of pixels on the basis of the inputted data;

a step for calculating a value representing luminance during a pth period of each of the plurality of pixels in sequence; and a step for accumulating the value representing the luminance during each period for each pixel, wherein, on the basis of a result of determining a pixel that the accumulated value thereof exceeds a value representing luminance that is indicated by the inputted data thereof, a value representing the luminance during the pth period is calculated.

The fifth aspect of the present invention provides an image display apparatus comprising:

a first pixel group including a plurality of pixels and a second pixel group including a plurality of pixels;

a common wiring to which the plurality of pixels of the first pixel group and the plurality of pixels of the second pixel group are connected in common;

a plurality of modulation signal wirings, each of which is connected to each of the plurality of pixels of the first pixel group and the plurality of pixels of the second pixel group, and applies a modulation signal for modulating a lighting time of the pixel to the pixel;

a first correction unit for outputting data to determine the lighting time of the pixel belonging to the first pixel group by carrying out calculation on the basis of a value representing a lighting state of the plurality of pixels of the first pixel group and a value representing a lighting state of the plurality of pixels of the second pixel group;

a second correction unit for outputting data to determine the lighting time of the pixel belonging to the second pixel group by carrying out calculation on the basis of a value representing a lighting state of the plurality of pixels of the first pixel group and a value representing a lighting state of the plurality of pixels of the second pixel group; and a modulation signal output circuit for outputting the modulation signal on the basis of the outputted data to determine the lighting time, wherein the second correction unit uses the a value that is updated on the basis of the calculation by the first correction unit, as the value representing the lighting state of the plurality of pixels of the first pixel group.

The sixth aspect of the present invention provides a driving method of an image display apparatus, the image display apparatus having:

a first pixel group including a plurality of pixels and a second pixel group including a plurality of pixels;

a common wiring to which the plurality of pixels of the first pixel group and the second pixel group are connected in common; and a plurality of modulation signal wirings, each of which is connected to each of the plurality of pixels of the first pixel group and the plurality of pixels of the second pixel group, and applies a modulation signal for modulating a lighting time of the pixel to the pixel;

the driving method comprising the steps of:

deciding the data to determine the lighting time of the pixel belonging to the first pixel group on the basis of a value representing a lighting state of the plurality of pixels of the first pixel group and a value representing a lighting state of the plurality of pixels of the second pixel group;

deciding the data to determine the lighting time of the pixel belonging to the second pixel group on the basis of a value representing a lighting state of the plurality of pixels of the first pixel group and a value representing a lighting state of the plurality of pixels of the second pixel group; and outputting the modulation signal on the basis of the decided data to determine the lighting time, wherein when deciding the data to determine the lighting time of the pixel belonging to the second pixel group, as the value representing the lighting state of the plurality of pixels of the first pixel group, a value that is updated on the basis of the calculation to decide the data to determine the lighting time of the pixel belonging to the first pixel group is used.

The seventh aspect of the present invention provides an image display apparatus comprising:

a plurality of pixel groups including a plurality of pixels, respectively;

a common wiring to which the plurality of pixels belonging to the plurality of pixel groups are connected in common;

a plurality of modulation signal wirings, each of which is connected to each of the plurality of pixels belonging to the plurality of pixel groups, and applies a modulation signal for modulating a lighting time of the pixel to the pixel;

a correction circuit for correcting inputted data and outputting the corrected data; and a modulation signal output circuit for outputting the modulation signal on the basis of the data that is corrected by the correction circuit, wherein when M pieces of periods in a period that the modulation signal can be outputted are referred to as first to Mth periods, where M is defined to be a natural number and p is defined to be a natural number in $2 \leqq p \leqq M$, the correction circuit has:

a calculation unit for calculating a value representing luminance during a first period of each of the plurality of pixel groups on the basis of the inputted data and calculating a value representing luminance during a pth period in sequence; and an accumulation unit for accumulating the value representing the luminance during each period for each pixel; and wherein on the basis of a result of determining a pixel group that the accumulated value thereof exceeds a predetermined value, a value representing the luminance during the pth period is calculated.

The eighth aspect of the present invention provides a driving method of an image display apparatus, the image display apparatus having:

a plurality of pixel groups including a plurality of pixels, respectively;

a common wiring to which the plurality of pixels belonging to the plurality of pixel groups are connected in common; and a plurality of modulation signal wirings, each of which is connected to each of the plurality of pixels belonging to the plurality of pixel groups, and applies a modulation signal for modulating the lighting time of the pixel to the pixel;

the driving method comprising:

a correcting step for correcting inputted data; and a step of outputting the modulation signal on the basis of the data that is corrected by the correction step, wherein when M pieces of periods in a period that the modulation signal can be outputted are referred to as first to Mth periods, where M is defined to be a natural number and p is defined to be a natural number in $2 \leqq p \leqq M$, the correction step includes:

a step for calculating a value representing luminance during a first period of each of the plurality of pixel groups on the basis of the inputted data;

a step for calculating a value representing luminance during a pth period of each of the plurality of pixel groups in sequence; and a step for accumulating the value representing the luminance during each period for each pixel group, wherein, on the basis of a result of determining a pixel group that the accumulated value thereof exceeds a predetermined value, a value representing the luminance during the pth period is calculated.

According to the present invention, it is possible to improve the correction accuracy.

Further features of the present invention will become apparent from the following description of exemplary embodiments with reference to the attached drawings.

BRIEF DESCRIPTION OF THE DRAWINGS

FIG. 12 shows an example of a histogram that is calculated for the image data during a certain one horizontal scanning period.

DESCRIPTION OF THE EMBODIMENTS

Figure 1:
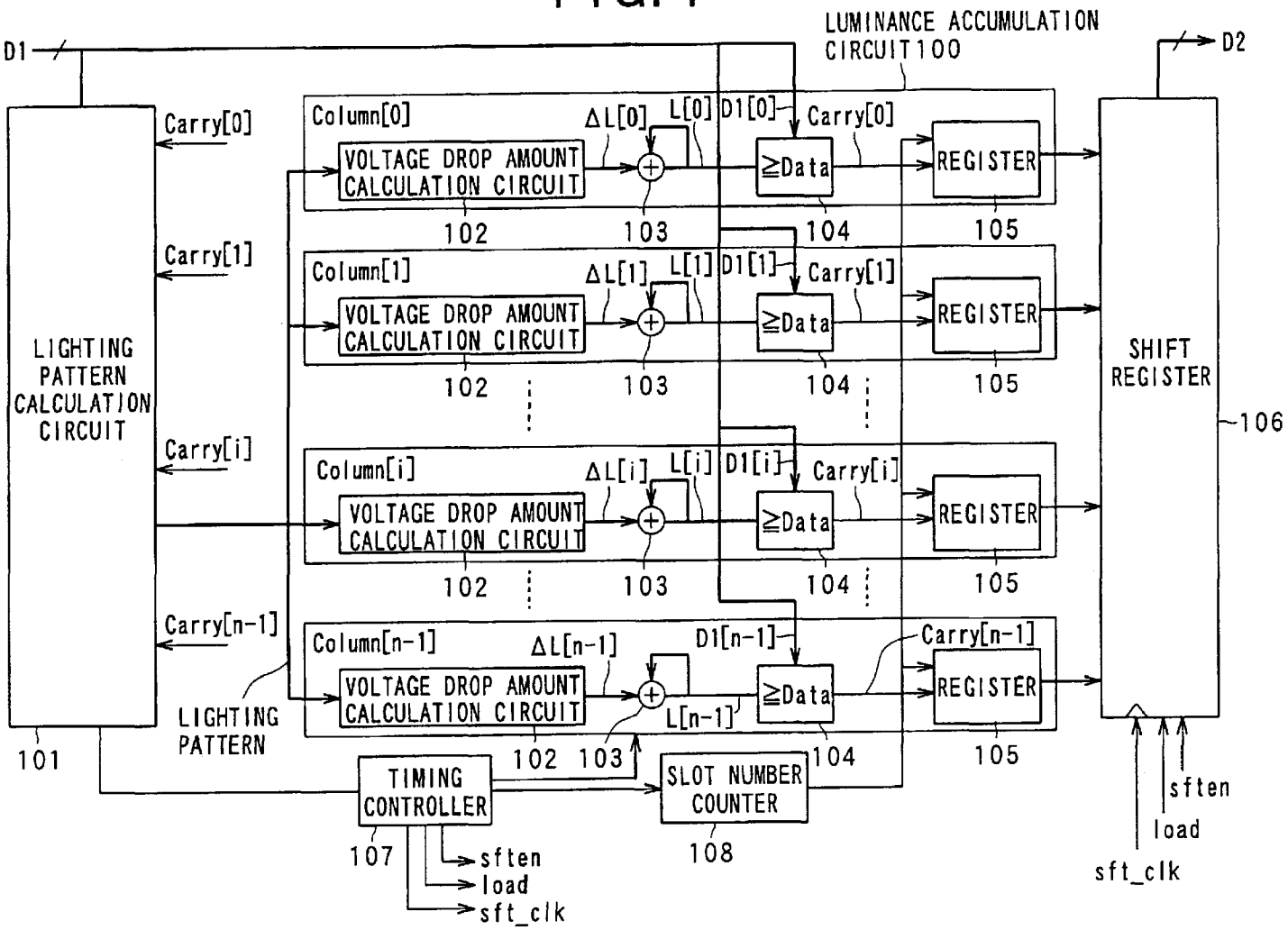
FIG. 1 is a view showing a structure of a corrected image data calculation circuit of an image display apparatus according to a first embodiment.

The present invention can be preferably applied to a display apparatus for displaying an image while driving a plurality of pixels. Particularly, the present invention can be preferably applied to a display apparatus that is configured so that a loss of a signal to be provided to a predetermined pixel affects the lighting state of other pixel. For example, in the configuration such that a plurality of pixels are connected to one common wiring and a modulation signal wiring is connected to each of respective pixels, the lighting state of each pixel is affected by the lighting state of other pixels. According to a more specific example, there is a configuration such that a plurality of pixels are driven in a matrix by a plurality of scan signal wirings (each of the scan signal wirings is equivalent to a common wiring) and a plurality of modulation signal wirings in a line-sequence. By applying the scan signal to the scan signal wiring that is the common wiring and applying the modulation signals from the modulation signal wirings, the pixels are driven. In this case, a signal level on the scan signal wiring is different depending on a position on the scan signal wiring because a voltage drop takes place when an electric current flows through the scan signal wiring. Accordingly, the voltage drop becomes large on the position far from the position where the scan signal is applied. In other words, the signal loss becomes large. The value of the electric current flowing through the scan signal wiring is decided by the driving state of each pixel. The driving state of each pixel is decided by the data to indicate the luminance of each pixel, for example, luminance data, so that the signal loss depends not only on a distance from the position where the signal is applied but also an image to be displayed.

As the pixel according to the present invention, various configurations can be used. For example, it is possible to use a pixel that is formed by combining a pixel circuit using a device such as a TFT for controlling the voltage to be applied with a liquid crystal, and a pixel that is formed by combining a pixel circuit using a device such as a TFT for controlling an electric current to be supplied to an EL material with the EL material.

Further, the configuration such that many colors can be represented by combining sub pixels having a plurality of colors (for example, R, G, and B sub pixels) and making them into a pixel has been known. According to the present invention, "a sub pixel" is not particularly distinguished from "a pixel" formed by combining a plurality of "sub pixels". Accordingly, the present invention does not exclude the configuration such that "the pixel" defined by the present invention is used as "the sub pixel" in the configuration that one pixel is formed by combining the sub pixels having plural different colors.

According to the present embodiment, the pixel formed by combining the electron-emitting device and a light-emitting member that emits light when electrons to be emitted from the electron-emitting device are irradiated thereto is used.

An example of an image display apparatus having a display panel for driving a plurality of electron-emitting devices in a simple matrix is shown below. In a simple matrix configuration, the electron-emitting devices on the selected row wiring (the scan signal wiring) are turned on electricity. In such an image display apparatus, when the current to be turned on flows through the same row wiring, the current is concentrated on the row wiring and this generates a voltage drop.

The configuration that the surface conduction electron-emitting device is used as the electron-emitting device is illustrated by an example below. Since the surface conduction electron-emitting device is characterized in that large amounts of currents flow through the row wiring and a voltage drop amount is large, particularly, the present invention can be preferably applied to the surface conduction electron-emitting device.

Hereinafter, with reference to the drawings, the embodiment(s) of the present invention will be described.

First Embodiment

According to the present embodiment, an image display apparatus having a display panel having the surface conduction electron-emitting devices connected in a simple matrix and a correction circuit for outputting corrected image data on the basis of inputted image data or the like will be described. In addition, as a drive circuit according to the present embodiment, an example using the drive circuit for driving the row wiring in a line-sequence and applying the modulation pulse which is modulated at least a pulse width thereof to the column wiring will be described. The lighting time of each pixel is controlled by a pulse width modulation (PWM). A pulse height modulation (PHM) is also carried out together with control of the lighting time by the pulse width modulation and a lighting intensity within a lighting time is controlled by a pulse height modulation, so that the number of tones that can be modulated may be increased. However, in order to simplify the explanation, an example of a pulse width modulation without combination of the pulse height modulation will be illustrated below.

According to the present embodiment, calculating the corrected image data that is obtained by correcting the inputted signal by the correction circuit and transferring it to the drive circuit, the influence of the voltage drop that is the signal loss is corrected. Thereby, the image display apparatus can display a preferable image. Further, the influence of the voltage drop in the pulse width modulation is described in columns 0084 to 0095 of JP-A No. 2003-223131 (columns to [0107] of US2003/0006976A1).

<<Image Display Apparatus>>

Figure 2:
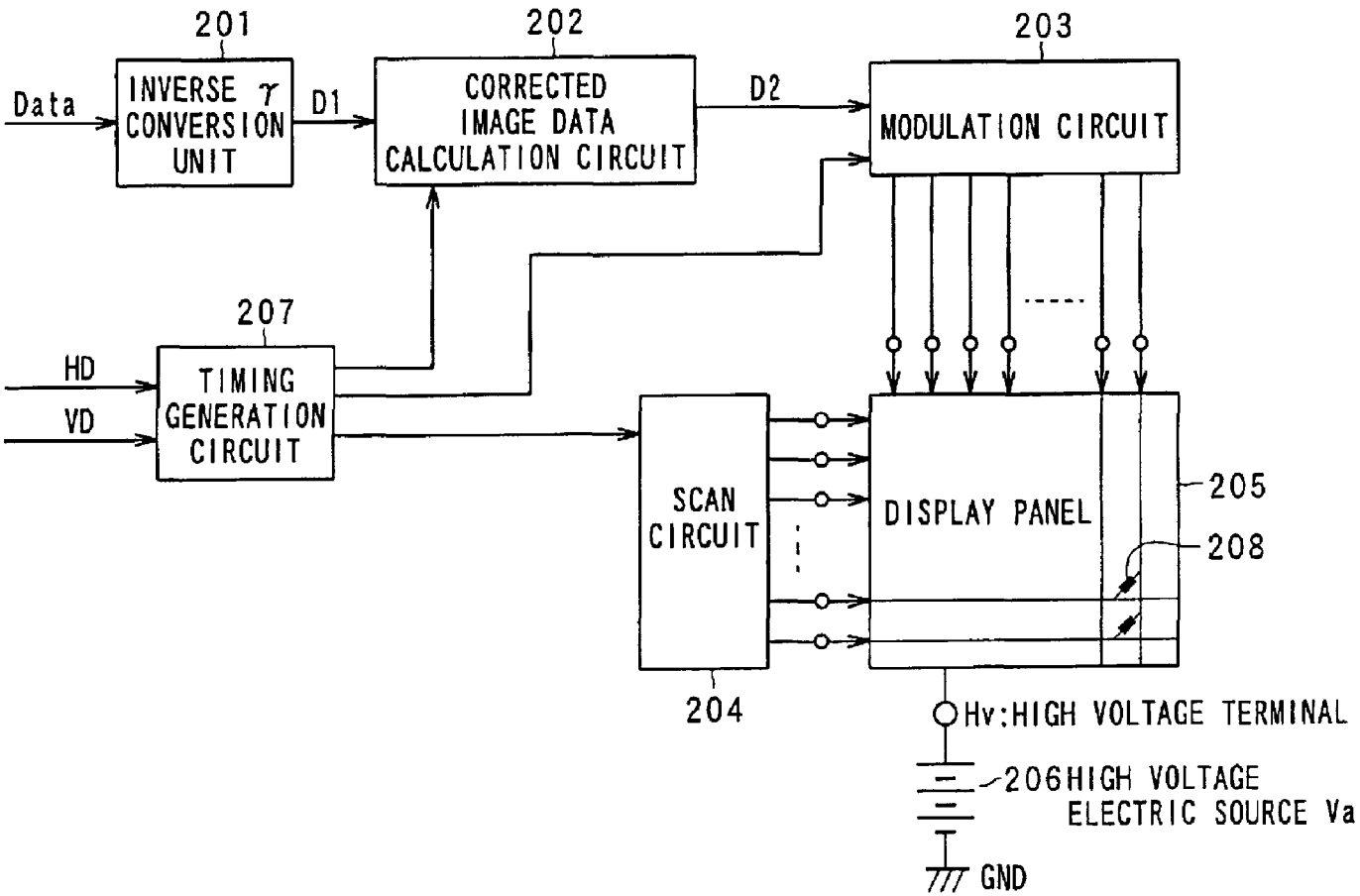
FIG. 2 is a block diagram of the image display apparatus according to the first embodiment.

FIG. 2 is a block diagram of the image display apparatus according to the present embodiment. The image display apparatus includes an inverse γ conversion unit 201, a corrected image data calculation circuit 202, a modulation circuit 203 that is a modulation signal output circuit, a scan circuit 204, a display panel 205, a high voltage electric source 206, a timing generation circuit 207, and a surface conduction electron-emitting device 208. The image display apparatus may be operated on the basis of a timing signal generated by the timing generation circuit 207 with reference to a horizontal synchronization HD and a vertical synchronization VD of the picture signal.

The image data Data are inputted in the inverse γ conversion unit 201. The image data Data are represented as "Data" in FIG. 2 for simplification and they correspond to color picture signals R, G, and B, in color image display apparatus, respectively to be inputted in the inverse γ conversion unit 201 in a point-sequence.

In the case of modulating the pulse width on the basis of a predetermined clock and driving it, the display panel 205 using the surface conduction electron-emitting device 208 has a property of emitting a light of luminance that is nearly linear for the application time of the pulse. Further, the pulse width modulation may modulate a time integration value of the luminance.

In order to adjust image data to a linear luminance property of the display panel 205, the inverse γ conversion unit 201 converts the image data Data using a curve of 2.2 powers so as to generate image data D1. Then, the inverse γ conversion unit 201 provides the image data D1 having a value in proportion to the luminance to the corrected image data calculation circuit 202. The image data D1 corresponds to the data to indicate the luminance of the pixel.

The corrected image data calculation circuit 202 outputs corrected image data D2 with reference to the image data D1. The corrected image data D2 corresponds to the data to determine the lighting time of the pixel.

The modulation circuit 203 is connected to the column wiring that is the modulation signal wiring of the display panel 205. The corrected image data D2 is inputted from the corrected image data calculation circuit 202 in this modulation circuit 203 and timing data is inputted from the timing generation circuit 207 in this modulation circuit 203. The modulation circuit 203 generates a modulation signal in accordance with the inputted corrected image data D2. Specifically, counting a clock signal in the number of time that is indicated by the corrected image data D2, a time that is not turned off of the modulation signal (namely, a time that is turned on) is determined. One period of the clock signal is made into a unit time (a time slot) for controlling the lighting time of the pixel. The modulation circuit 203 outputs the modulation signal to the column wiring that is connected to each of a plurality of the surface conduction electron-emitting devices 208.

The scan circuit 204 is connected to the row wiring that is the scan signal wiring of the display panel 205. The scan circuit 204 provides a selection signal (a scan signal) to the scan signal wiring to which the surface conduction electron-emitting devices 208 to be driven is connected. Generally, the scan circuit 204 carries out scanning in a line-sequence for selecting the scan signal wiring in sequence for each row. However, the present embodiment is not limited to this and the present embodiment may be configured so that the scan circuit 204 carries out interlace scanning or selects a plurality of rows at the same time. In other words, the scan circuit 204 selects a row by giving a selection electric potential for a predetermined time to the row wiring to which some surface conduction electron-emitting devices 208 that are target for driving among a plurality of surface conduction electron-emitting devices 208 included in the display panel 205. In addition, the scan circuit 204 does not select the row by giving a no-selection electric potential for a time other than the predetermined time to the row wiring.

The timing generation circuit 207 generates a timing signal for the modulation circuit 203, the scan circuit 204, and the corrected image data calculation circuit 202.

The display panel 205 includes an electron source to arrange a plurality of surface conduction electron-emitting devices 208 in its inside and a plurality of light-emitting members that are arranged so as to be opposite to the electron source.

Figure 13:
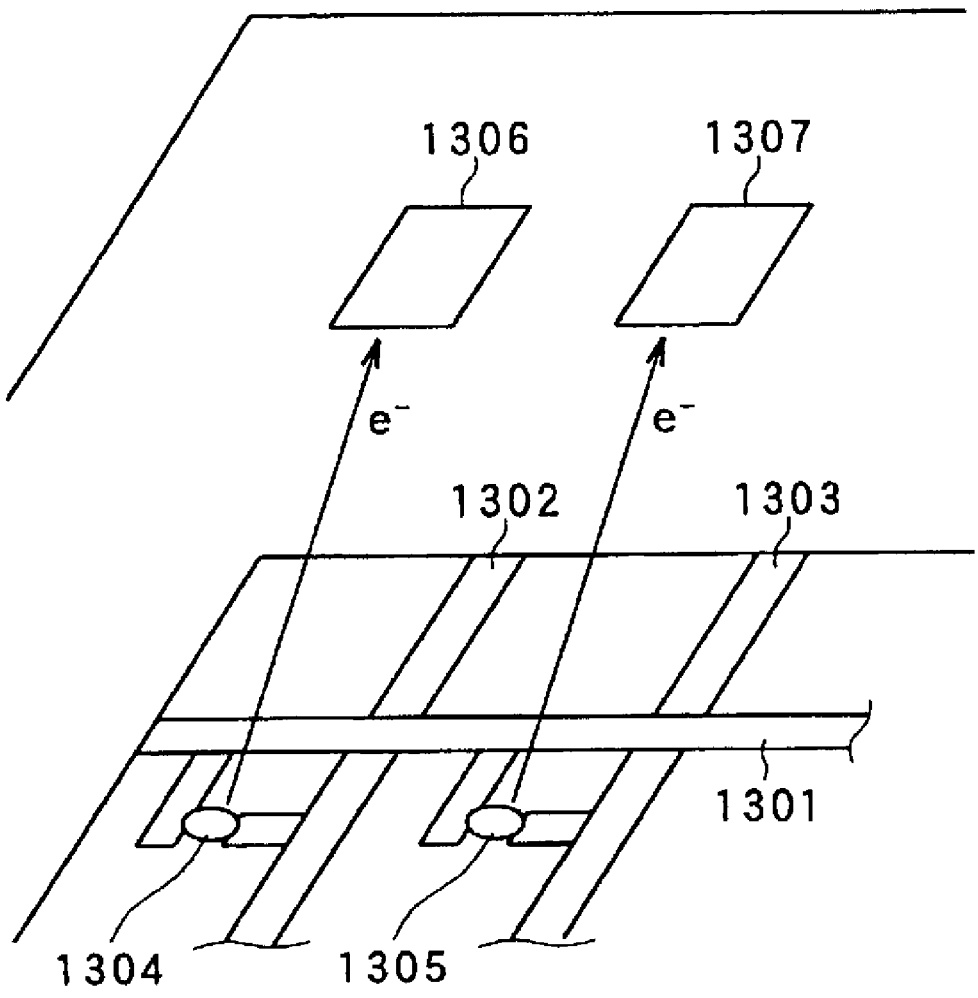
FIG. 13 is a typical view of a scan signal wiring that is a common wiring, a plurality of surface conduction electron-emitting devices to form a plurality of pixels to be connected to the scan signal wiring, a plurality of modulation signal wirings, and a light-emitting member to form a pixel.

FIG. 13 is a typical view of a scan signal wiring that is a common wiring, a plurality of surface conduction electron-emitting devices to configure a plurality of pixels to be connected to the scan signal wiring, a plurality of modulation signal wirings, and a light-emitting member to configure a pixel. In order to make it clearly understandable, a pixel only for one row is described.

One pixel (a first pixel) is configured by a surface conduction electron-emitting device 1304 that is an electron-emitting device and a phosphor 1306 that is a light-emitting member. One pixel (a second pixel) is configured by a surface conduction electron-emitting device 1305 that is an electron-emitting device and a phosphor 1307 that is a light-emitting member.

The surface conduction electron-emitting devices 1304 and 1305 are connected to one common wiring (namely, a scan signal wiring 1301) in common. Accordingly, the first pixel and the second pixel are connected to one common wiring in common.

The modulation signal is supplied to the first pixel by a modulation signal wiring 1302 and the modulation signal is supplied to the second pixel by a modulation signal wiring 1303.

Further, an electron to be emitted from the surface conduction electron-emitting device is irradiated to the light-emitting member arranged so as to be opposite to the electron source to generate a light. Due to this set of lights, an image is displayed. The luminance of the light is controlled by an irradiation amount of electrons from the surface conduction electron-emitting device. The irradiation amount of electrons from the surface conduction electron-emitting device is controlled by a volume of a voltage to be applied to the surface conduction electron-emitting device and an application time of the voltage. Accordingly, by controlling a difference between an electric potential of a scan signal to be outputted from the scan circuit 204 and an electric potential of a modulation signal to be outputted from the modulation circuit 203 and controlling the application time of the modulation signal within an application period of the scan signal, it is possible to control a desired electron emission amount. As described above, according to this embodiment, a pulse width modulation without a pulse height modulation is carried out.

The electron source has a plurality of scan signal wirings and a plurality of modulation signal wirings so that a plurality of surface conduction electron-emitting devices 208 can be driven in a matrix. Applying a scan signal to this scan signal wiring, a modulation signal is applied to a modulation signal wiring.

The high voltage electric source 206 provides a high voltage to the side of a light-emitting member in order to direct an electron emitted from the electron source to the light-emitting member.

<Corrected Image Data Calculation Circuit 202 (Corresponds to "a Correction Circuit" of the Present Invention)>

FIG. 1 is a schematic view showing the corrected image data calculation circuit 202 that is a correction circuit.

The corrected image data calculation circuit 202 includes a lighting pattern calculation circuit 101, a voltage drop amount calculation circuit 102, an accumulation circuit (an accumulator) 103, a comparator 104, a register 105, and a shift register 106.

In FIG. 1, a block formed by the voltage drop amount calculation circuit 102, the accumulation circuit 103, the comparator 104, and the register 105 is referred to as a luminance accumulation circuit 100. The top luminance accumulation circuit 100 in FIG. 1 corresponds to a first correction unit, and the second top luminance accumulation circuit 100 and the lighting pattern calculation circuit 101 in FIG. 1 correspond to a second correction unit.

The luminance accumulation circuit 100 is provided for each wiring corresponding to each modulation signal wiring of the display panel 205. In addition, a timing controller 107 synchronizes the luminance accumulation circuit 100, the lighting pattern calculation circuit 101, the shift register 106, and a slot number counter 108.

The timing controller 107 controls the operation of the luminance accumulation circuit 100 for each modulation signal wiring and the operation of the slot number counter to be described later. Specifically, by controlling clear and enable of the accumulator 103 and clear and enable of the slot number counter 108, timing for accumulating the luminance and time slots per modulation signal wiring are managed.

The voltage drop amount calculation circuit 102 is a circuit for calculating luminance $\Delta L[I]$ in a modulation signal wiring I (column I) defining the lighting patterns of all modulation signal wirings as input. Here, the luminance $\Delta L[I]$ is a value representing luminance within a predetermined period of time of the Ith pixel. The luminance $\Delta L[I]$ is calculated in response to each period of time, respectively. Further, it is not necessary to synchronize the calculation by the correction circuit with output of the modulation signal from the modulation signal output circuit and the calculation may be carried out without synchronization.

The luminance $\Delta L$ to be calculated by the voltage drop amount calculation circuit 102 will be obtained as follows.

The calculation will be carried out according to a Kirchhoff law in consideration of: a lighting pattern; output resistances of a scan signal wiring, a modulation signal wiring, the scan circuit 204, and the modulation circuit 203; and an I-V characteristic of the surface conduction electron-emitting device 208. Thereby, a voltage drop amount (a signal loss amount) of each part of the scan signal wiring and a voltage to be applied to each surface conduction electron-emitting device are calculated. Next, from a voltage drop amount and a characteristic curve between the applied voltage and the emission current of the electron-emitting device, the emission current amount is estimated. Further, in consideration of a characteristic of the phosphor, the luminance $\Delta L$ to be stored in the voltage drop amount calculation circuit 102 is obtained.

Although these calculations are complicated, they can be simplified by storing the results of calculations about a plurality of lighting patterns in advance in a memory.

The slot number counter 108 counts the number of slots indicating how many times accumulation is made when accumulating the luminance in a sequence in synchronization with a slot. For example, the slot number counter 108 counts the number of slots "1" when the luminance is accumulated at the first timing and the slot number counter 108 counts the number of slots "2" when the luminance is accumulated at the second timing.

<Operation of Corrected Image Data Calculation Circuit 202>

Figure 3:
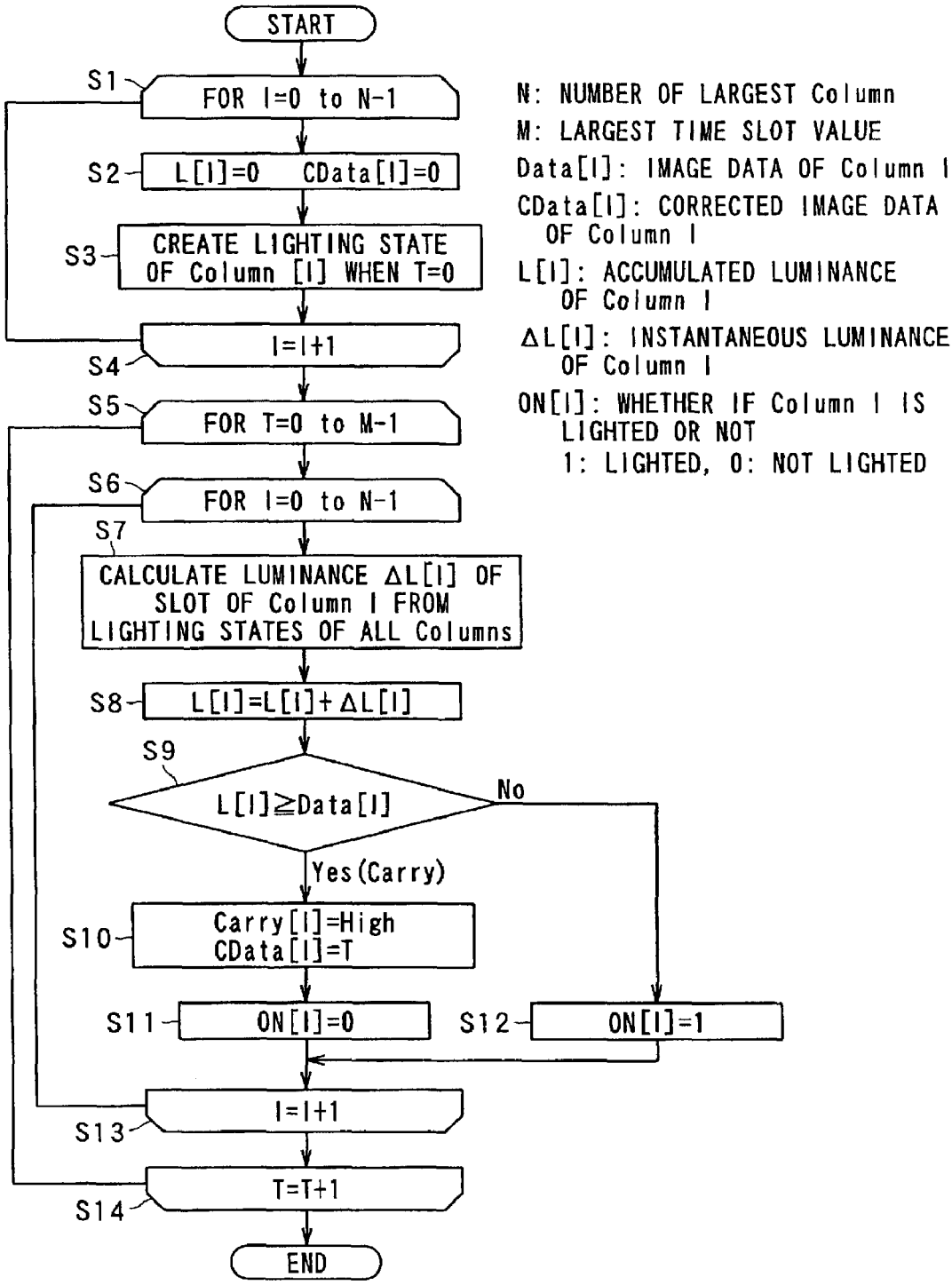
FIG. 3 is a flow chart showing the operation of the corrected image data calculation circuit of the image display apparatus according to the first embodiment.

Next, the operation of the corrected image data calculation circuit 202 in FIG. 1 will be described with reference to FIG. 3. FIG. 3 is a flow chart showing the operation of the corrected image data calculation circuit 202 of the image display apparatus according to the present embodiment. In the corrected image data calculation circuit 202 in FIG. 1, there is a portion where parallel processing is carried out by a plurality of luminance accumulation circuits 100, however, the flow chart in FIG. 3 is partially indicated in a sequence processing for convenience of description.

<Lighting Pattern Calculation Circuit 101>

The lighting pattern calculation circuit 101 is a circuit for creating a lighting pattern for a certain time. Further, the lighting pattern refers to the application state of the voltage to each modulation signal wiring. For example, in the case of lighting (turning ON) the all display devices connected to four modulation signal wirings, the lighting pattern is represented as (1, 1, 1, 1) ("1" means ON and "0" means OFF).

According to the present embodiment, the correction to make the lighting time shorter is not carried out, so that there is no necessity to predict the lighting state after correction with respect to a first period of time (time slot T=0 period). Accordingly, the lighting state of the first period can be decided from the image data to be inputted (the inputted image). With respect to each period of time after the second period of time, the lighting state of each display device has an influence of correction, so that it is not preferable to set the lighting state only by the inputted image data. As a result, according to the present embodiment, the lighting state after correction of each display device is predicted, and this predicted lighting state is used for next correction calculation. In order for such processing to be available, the lighting pattern to be determined in the lighting pattern calculation circuit 101 is formed to be rewritten on the basis of a result of correction calculation. Further, practical application of a modulation signal is made after the calculation in this correction circuit is completed, so that on the stage of the correction calculation, the lighting having the result of the correction reflected is not carried out. Hereinafter, the procedures will be described in sequence.

If the image data D1 for one horizontal scan period of time is retrieved, the lighting pattern calculation circuit 101 analyzes the image data D1 and at a point of time when a time slot T=0, the lighting pattern is calculated. When there are N pieces of modulation signal wirings, the lighting pattern calculation circuit 101 creates the lighting patterns from the first modulation signal wiring 0 to a modulation signal wiring N−1 on the basis of the image data D1. In the flow chart shown in FIG. 3, with reference to the N pieces of modulation signal wirings from 0 to N−1, the lighting patterns are calculated (S1 to S4). Further, in a step S2, setting the accumulated luminance value (L[1]) in the scan signal wiring I at "0", a value of the corrected image data in the scan signal wiring I (CDdata [I]) is set at "0".

In a step S3, a lighting state of a display device of the modulation signal wiring I when T=0 is created (S3).

With respect to the image data D1[I] for the modulation signal wiring I, if D1[I]>0, the display device is determined as "lighting", and if D1[I]=0, the display device is determined as "not lighting" (where I=0, 1, . . . , N−1). In other words, during the first period of time, the pixel that the image data is 0 is set as "not lighting", and the pixel that the image data is larger than 0 is set as "lighting". Further, determination of lighting or not lighting serves to carry out the following calculations and at this point of time, the display device has not driven by the data having the result of the correction in this case reflected yet.

<Luminance Accumulation Circuit 100>

If the lighting pattern of a time slot T=0 is calculated for the modulation signal wirings 0 to N−1, this lighting pattern is inputted in the voltage drop amount calculation circuit 102 in the luminance accumulation circuit 100 that is provided for each modulation signal wiring. Assuming that there are M pieces of time slots, the luminance accumulation circuit 100 calculates while counting the number of time slots from the first time slot 0 to the Mth time slot M−1 (S5, S14). In this case, the M pieces of time slots correspond to M pieces of periods of time in a selection period (a period that a modulation signal can be outputted). M is defined to be a natural number not less than 2.

In steps S6 to S13, the following procedures will be carried out:

Calculation of luminance ΔL in consideration of an influence of a voltage drop in the corresponding period of time (corresponding to a pth period of time), Addition (accumulation) of the luminance ΔL with the accumulated values of the luminance ΔL of 1 to (p−1)th periods of time, Determination if the addition result (the accumulated value) exceeds the inputted data (the data representing the luminance of the pixel) or not, and Rewriting of the lighting state when the addition result (the accumulated value) exceeds the inputted data.

Step S7 corresponds to the operation of the voltage drop amount calculation circuit 102 in FIG. 1. Step S8 corresponds to the accumulation circuit 103 in FIG. 1 and step S9 corresponds to the comparator 104 in FIG. 1. Further, in the block diagram of FIG. 1, a plurality of luminance accumulation circuits 100 obtains the corrected image data for each modulation signal wiring by the parallel operation. In the flow chart of FIG. 3, the processing for obtaining the corrected image data is represented by loop processing (S6, S13) for convenience of description. In any of the serial processing by the loop calculation or the parallel processing using a plurality of circuit blocks, the present invention is practicable.

<Voltage Drop Amount Calculation Circuit 102>

The voltage drop amount calculation circuit 102 refers to a lighting pattern of all modulation signal wirings and calculates the luminance ΔL[I] in the modulation signal wiring I (S7). The voltage drop amount calculation circuit 102 calculates the luminance amount that is different for each modulation signal wiring even if referring to the same lighting pattern. It is because that the voltage drop amount in a row wiring direction is different for each modulation signal wiring.

Further, the luminance ΔL is an amount that is decided by the volume of the voltage drop on the scan signal wiring that is selected when the pixel is driven by the lighting pattern, a characteristic curve between the applied voltage and the emission current of the surface conduction electron-emitting device, and a characteristic of a phosphor that is placed on the display panel.

The voltage drop amount calculation circuit 102 calculates the volume of the voltage drop for the lighting pattern for each time, however, a table that has been calculated in advance may be referred.

If the luminance ΔL[I] is calculated, the voltage drop amount calculation circuit 102 outputs the calculation result to the accumulation circuit 103.

During the first period of time, on the basis of the lighting state to be determined by the inputted image data, the luminance ΔL (namely, the value representing the luminance during this period of time) is calculated. During each period of time after the second period of time, on the basis of a lighting state obtained by updating the lighting state that is determined by the inputted image data in accordance with the following calculation result (however, depending on the following calculation result, the lighting state may not be updated), the luminance ΔL is calculated.

<Accumulation Circuit 103>

The accumulation circuit 103, in synchronization with a timing signal from the timing controller 107, accumulates the luminance ΔL[I] in sequence in accordance with counting up of the slot number counter 108 and outputs the accumulated luminance L (corresponding to "the accumulated value" according to the present invention) in sequence (S8). In other words, the accumulation circuit 103 outputs the luminance L in sequence by accumulating the value calculated by the voltage drop amount calculation circuit 102 (the luminance ΔL [I]) for each timing in sequence. In other words, the accumulation circuit 103 temporarily accumulates the value that is calculated by the voltage drop amount calculation circuit 102 so as to calculate the accumulated value. The accumulation circuit 103 accumulates the luminance ΔL of each period of time in sequence. However, since the luminance ΔL corresponding to a pixel becomes 0 after a period of time at which the accumulated value exceeds the image data for the pixel, the accumulation circuit 103 may be configured so as to stop the accumulation with respect to that pixel after that period of time.

The accumulation circuit 103 outputs the accumulated luminance L to the comparator 104.

<Comparator 104>

The comparator 104 compares the Data [I] of the image data D1 corresponding to each modulation signal wiring (corresponding to a value of the data to indicate the luminance of the pixel) with the accumulated luminance L[I], whenever the luminance ΔL[I] during each period of time is calculated and further added to the accumulated value from the first period of time to the former period of time (S9). In the case that the value obtained by accumulating the luminance ΔL up to a predetermined period of time (corresponding to a qth period of time) exceeds the image data, in order to reflect the result of the correction calculation here on a condition for carrying out the correction calculation, the lighting pattern is updated. However, it is assumed that the accumulated value up to the former period of time (corresponding to the (q−1)th period of time) thereof does not exceed the image data. Therefore, in the case that the accumulated luminance L[I] is the same as the Data[I] or is larger than the Data[I] (Yes), the comparator 104 makes output Carry [I] into "High" (S10). In this case, when the accumulated value is the same as the value of the image data or becomes the larger value than the value of the image data, determination of "exceed" is made. However, when the accumulated value is larger than the value of the image data, determination of "exceed" may be made.

When Carry[I] is made into "High", the register 105 holds the value of the slot number counter 108 (CData[I]) as the corrected image data (corresponding to "the data to be outputted by the correction unit" of the present invention) (S10). In addition, the comparator 104 also outputs a signal indicating that Carry[I] is "High" to the lighting pattern calculation circuit 101. The lighting pattern calculation circuit 101 updates the lighting pattern of the first modulation signal wiring into an OFF state (ON[I]=0) (S11). The comparator 104 determines if the accumulated luminance exceeds the image data, and on the basis of this result, the lighting state is updated. On the basis of this updated lighting state, the luminance ΔL for a period of time after that is calculated.

In the case that the accumulated luminance L[I] is smaller than the Data[I] (NO of S9), the lighting pattern calculation circuit 101 maintains the lighting pattern of the Ith modulation signal wiring at the ON state (ON[I]=1) (S12).

Repeating the operations of steps S5 to S14, when Carry[I] is made into "High" for the circuits corresponding to all modulation signal wirings, the all corrected image data of the horizontal scan period of time are stored in the register 105.

The register 105 outputs the corrected image data to the shift register 106 in parallel if the corrected image data of all modulation signal wirings for one horizontal scan period of time are decided.

The shift register 106 serializes the corrected image data that is inputted in parallel on the basis of a timing signal (a shift clock "sft_clk", a load "load", a shift enable "sft_en") from the timing generation circuit 207. The shift register 106 outputs the serialized corrected image data D2 to the modulation circuit 203.

If the corrected image data D2 is inputted in the modulation circuit 203, the modulation circuit 203 outputs a modulation signal of a pulse width corresponding to the corrected image data D2 to each modulation signal wiring. On the basis of a timing signal from the timing generation circuit 207, the scan circuit 204 outputs a selection signal to each scan signal wiring in synchronization with the modulation signal.

<<Simplified Corrected Image Data Calculation Circuit

Next, using a very-simplified example, an example of the operation of the corrected image data calculation circuit according to the present embodiment will be described. In practice, there are several hundreds to several thousands pieces of the modulation signal wirings of the image display apparatus, however, the number of the modulation signal wirings of the image display apparatus are defined as four here in order to simplify the explanation.

Figure 4:
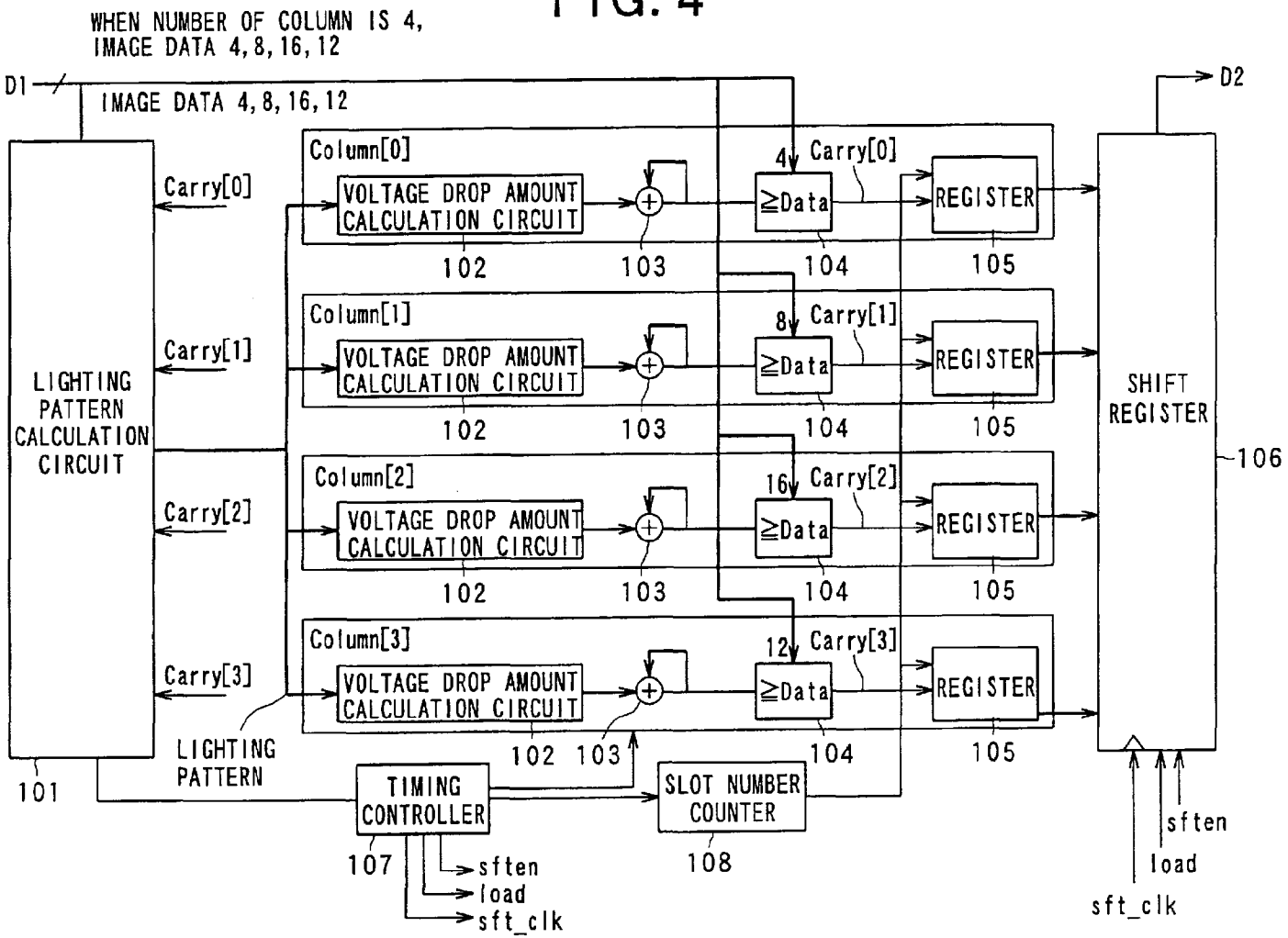
FIG. 4 is a view showing a constituent example of the corrected image data calculation circuit of the image display apparatus according to the first embodiment.

FIG. 4 is a view showing a constituent example of the corrected image data calculation circuit 202 of the image display apparatus according to the present embodiment.

An example that the image data D1 of each modulation signal wiring are 4, 8, 16, and 12 during a predetermined horizontal scan period of time will be described. If the image data D1 is inputted, the lighting pattern calculation circuit 101 calculates a lighting pattern when a time slot T=0. In the image data D1, all of the modulation signal wirings are turned ON (all of 4, 8, 16, and 12 are larger than 0), namely, a lighting pattern (1, 1, 1, 1). Here, the lighting pattern corresponds to the lighting states of modulation signal wirings 0 to 3 in sequence from left.

If the lighting pattern is inputted, the voltage drop amount calculation circuit 102 calculates the luminance for the inputted lighting pattern. The voltage drop amount calculation circuit 102 calculates the volume of the luminance ΔL for the lighting pattern in consideration of the voltage drop amount defining the luminance ΔL when no voltage drop takes place as "1". During the first period of time, the luminance ΔL is calculated on the basis of the above-described lighting pattern to be determined by the image data. In the pth period of time (p is incremented in sequence from 2), the luminance ΔL is calculated on the basis of the lighting pattern that is updated by the following calculation.

The accumulation circuit 103 accumulates the luminance in sequence corresponding to counting-up of the slot number counter and may calculate the luminance amount (the accumulated value) corresponding to each time slot in sequence.

The comparator 104 compares the value of the image data (4, 8, 16, 12) for each modulation signal wiring with the accumulated luminance amount for each timing.

Figures 5A, 5B:
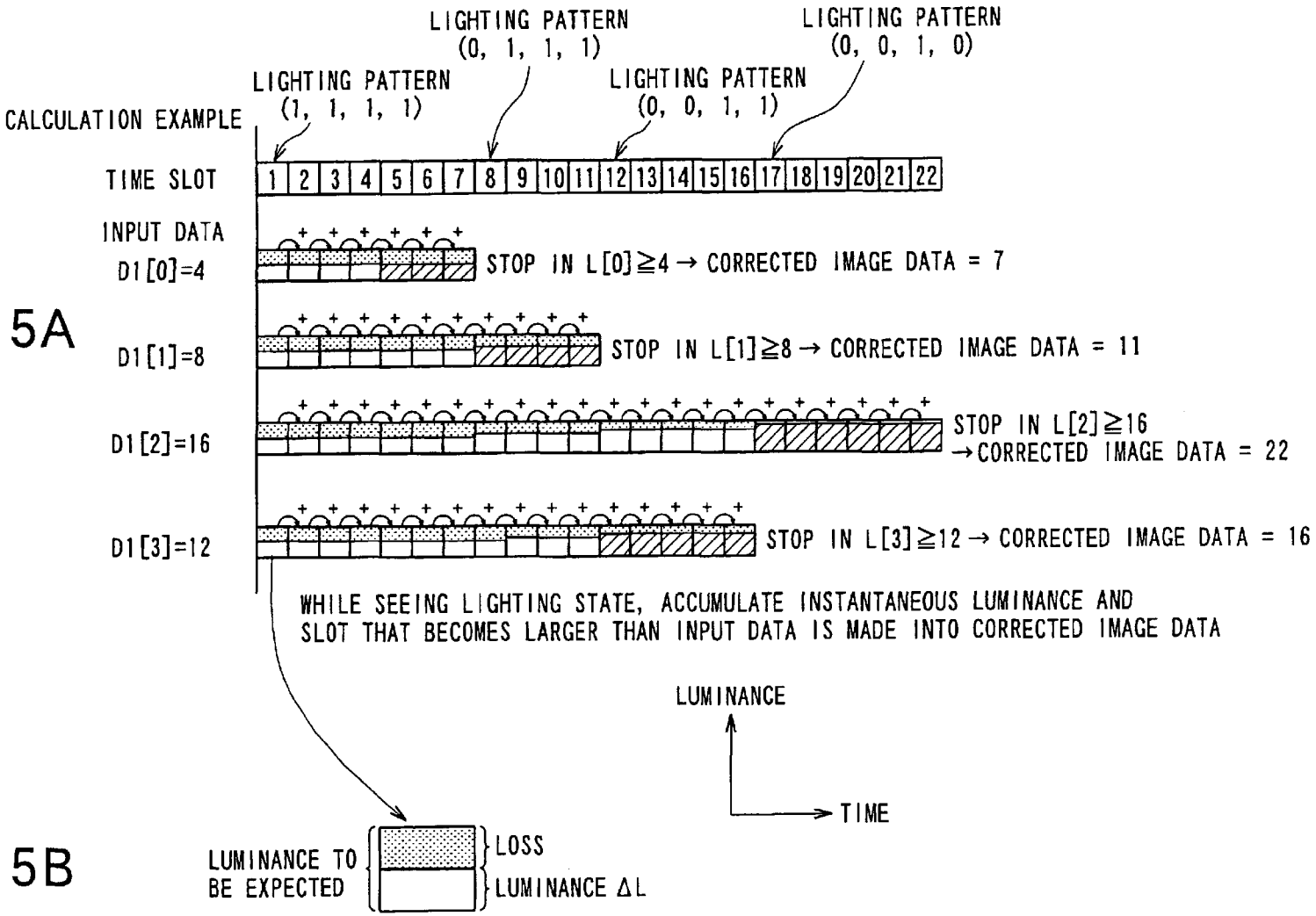
FIG. 5A and FIG. 5B are typical views showing an example of comparing a value representing luminance of a display device with an accumulated value.

FIG. 5A and FIG. 5B are typical views showing an example of comparing a value of the image data for each modulation signal wiring (corresponding to "a value of data to indicate the luminance of the pixel" of the present invention) with the accumulated value. With reference to FIG. 5A and FIG. 5B, the procedures that the corrected image data is calculated will be described.

In FIG. 5A, lateral axes of respective bar graphs corresponding to the inputted data D1[0] to D1[3] (a horizontal direction on the paper) show a time. Each bar graph is formed in a shape such that rectangles corresponding to each period of time (time slot) shown in FIG. 5B are connected laterally. The size in a longitudinal axial direction (a vertical direction on the paper) of each rectangle indicates the luminance that is expected as the luminance of that period of time. According to the present embodiment, the expected luminance is that assuming that no voltage drop takes place, and here, the expected luminance is defined as "1". The upper dotted portion in each rectangle indicates a loss of luminance due to loss of a signal. Here, the dotted portion indicates a loss of luminance due to a voltage drop. The lower white portion in the rectangle indicates luminance ΔL to be calculated as the luminance that is obtained in practice in consideration of the voltage drop. In addition, a shaded portion corresponds to the luminance that is compensated by extending the length of the pulse by this correction calculation.

The following explanation will be made assuming that image data D1 corresponding to modulation signal wirings 0 to 3 are 4, 8, 16, and 12.

The value of the image data Data[0] to be inputted corresponding to a pixel connected to a modulation signal wiring 0 is "4".

In the case that no correction is made, the pixel is driven for four time slots and at that point, driving has been terminated. However, since there is an influence of a voltage drop in practice, the luminance for one time slot does not take a value "1" indicating the luminance to be required for the display device to be lowered (the dotted portion of the drawing). The accumulation circuit 103 accumulates the luminance amount when this luminance is lowered. In other words, calculating the sizes of the white portions in the rectangles for each period of time, they are accumulated. The sizes of the white portions are calculated by the voltage drop amount calculation circuit in accordance with the set lighting pattern. For the first period of time, the lighting pattern which is set on the basis of the image data is used. The comparator 104 compares the accumulated luminance amount with the image data (=4), and in a time slot that the accumulated luminance is 4 or more (in FIG. 5A, 7th slots), the comparator 104 makes Carry[0] into "High". A number of a period of time at which the accumulated value exceeds the indicated luminance "4" can be used as the corrected image data, so that thereby, the corrected image data of the modulation signal wiring 0 is made into "7".

When Carry[0] is made into "High", the lighting pattern calculation circuit 101 updates the lighting pattern from the next time slot. In FIG. 5A, the lighting pattern is changed from (1, 1, 1, 1) into (0, 1, 1, 1). If the lighting pattern is updated, the voltage drop amount in the scan signal wiring is changed. Further, the influence of the voltage drop in the pulse width modulation is described in columns 0084 to 0095 of JP-A No. 2003-223131 (columns [0095] to [0107] of US 2003/0006976 A1).

In modulation signal wirings 1 to 3 of FIG. 5A, the voltage drop amount up to the time slot 7 and the voltage drop amount after the time slot 8 are different. When the lighting pattern becomes (0, 1, 1, 1), the voltage drop amount is decreased. In other words, elevation of the electric potential on the scan signal wiring due to the voltage drop is decreased and the luminance ΔL of the display devices corresponding to the modulation signal wirings 1 to 3 are increased as compared to the previous period of time. In FIG. 5A, it is shown that the dotted portions are decreased and the luminance ΔL is increased. After the time slot 8, on the basis of the updated lighting state, the luminance ΔL is calculated. By making calculation on the basis of the updated lighting state, it becomes possible to perform compensation with predicting the corrected lighting state.

Since then, calculation, accumulation, and comparison of the luminance ΔL are carried out in sequence. In FIG. 5A, when the time slot becomes "11", the luminance amount of the modulation signal wiring 1 exceeds its image data (=8). Thereby, the corrected image data of the modulation signal wiring 1 is decided to be "11" and Carry[1] is made into "High".

If Carry[1] becomes "High", the lighting pattern calculation circuit 101 updates the lighting pattern from the next time slot. In FIG. 5A, the lighting pattern is changed from (0, 1, 1, 1) into (0, 0, 1, 1). If the lighting pattern is updated, the voltage drop amount in the scan signal wiring is changed.

Next, when the time slot becomes "16", the luminance amount of the modulation signal wiring 3 exceeds its image data (=12). Thereby, the corrected image data of the modulation signal wiring 3 is decided to be "16" and Carry[3] becomes "High".

If Carry[3] becomes "High", the lighting pattern calculation circuit 101 updates the lighting pattern from the next time slot. In FIG. 5A, the lighting pattern is changed from (0, 0, 1, 1) into (0, 0, 1, 0). If the lighting pattern is updated, the voltage drop amount in the scan signal wiring is changed.

Next, when the time slot becomes "22", the luminance amount of the modulation signal wiring 2 exceeds its image data (=16). Thereby, the corrected image data of the modulation signal wiring 2 is decided to be "22" and Carry[2] becomes "High".

If Carry[2] becomes "High", the lighting pattern calculation circuit 101 updates the lighting pattern from the next time slot. In FIG. 5A, the lighting pattern is changed from (0, 0, 1, 0) into (0, 0, 0, 0). Then, if the lighting pattern becomes (0, 0, 0, 0), calculation of the corrected data is terminated.

As described above, the corrected image data D2 (7, 11, 22, 16) is decided for the inputted image data D1 (4, 8, 16, 12) in each modulation signal wiring.

The corrected image data calculation circuit 202 outputs the decided corrected image data D2 to the modulation circuit 203. The modulation circuit 203 performs the pulse width modulation on the basis of the inputted corrected image data and outputs a drive signal to the display panel 205. The display panel 205 can display an image with reduced influence of the voltage drop in the scan signal wiring.

The examples described with reference to FIG. 4 and FIG. 5A are very simplified. However, the present embodiment can be applied to the display panel that is used in practice. According to the embodiment(s) of the present invention, by calculating the corrected image data for the inputted image data, change of the voltage drop can be also considered, so that the correction can be carried out at a high degree of accuracy. In addition, as a result of correction, the display panel can display an excellent image having small influence of the voltage drop.

MODIFIED EXAMPLE

Further, according to the present embodiment, a time width that is the same as an unit time for controlling the pulse width of the pulse width modulation signal is set as a time width for each period of time to calculate the luminance ΔL and the unit time to control the pulse width of the pulse width modulation signal is always fixed. However, the present embodiment is not limited to this. For example, it is also possible to uneven the unit time for controlling the pulse width of the pulse width modulation signal and/or a time width of each period of time for calculating the luminance ΔL. As time passed, the time step may be changed. For example, the time slot width of the position corresponding to a low tone may be made short and the time slot width of the position corresponding to a high tone may be made long. In this way, in the case that the time step is changed, accumulation in response to this time slot width may be carried out when accumulating the luminance. Counting-up of the slot number counter is defined to be changed in accordance with this.

Figure 9:
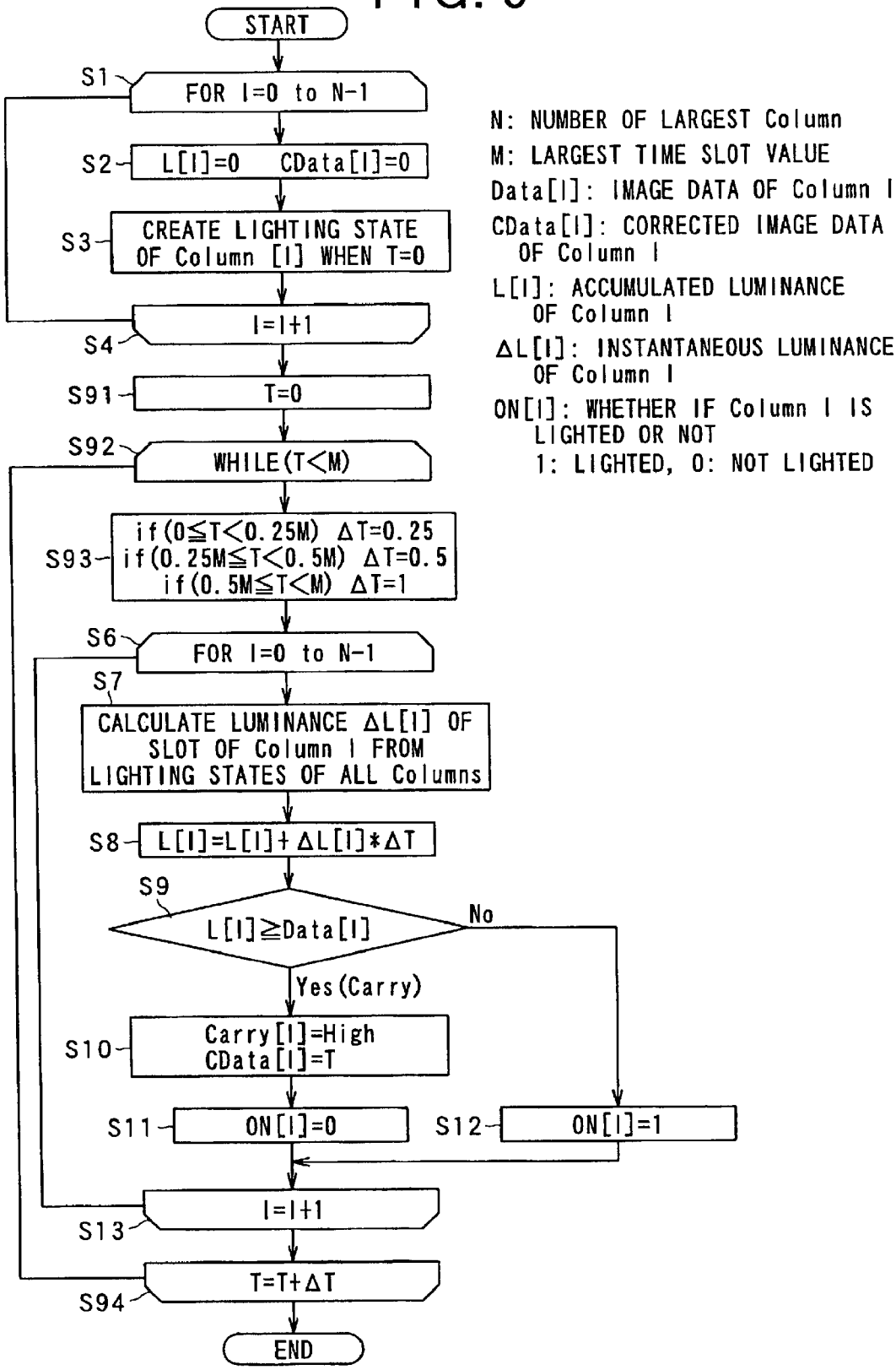
FIG. 9 is a flow chart for explaining the processing to make a time slot width uneven according to a modified example of the first embodiment.

FIG. 9 is a flow chart for explaining the processing to make a time slot width uneven.

At first, as same as FIG. 3, the lighting pattern calculation circuit 101 analyzes the image data D1 and calculates the lighting pattern (S1 to S4).

Subsequently, a time slot T=0 is defined and a loop calculation described by a While loop in FIG. 9 is carried out in sequence (S92 to S94).

At first, a time slot width ΔT when the accumulation circuit 103 carries out accumulation calculation is selected. Assuming that the largest time slot value is M, as shown by step S93 of FIG. 9, the time slot width ΔT is selected as ΔT=0.25 in the range of 0≦T<0.25M, as ΔT=0.5 in the range of 0.25≦T<0.5M, and as ΔT=1.0 in the range of 0.5M≦T<M (S93).

Next, the accumulation circuit 103 carries out the accumulation calculation for each modulation signal wiring, however, according to the present embodiment, differently from FIG. 3, the time slot width is multiplied to the luminance ΔT when performing accumulation to accumulate the luminance ΔT after accumulation.

If the time slot width of ΔT is $2^{-N}$ (N=an integer such as 0, 1, 2 . . . ) such as 0.25 and 0.5, this multiplication can be carried out by a bit shift calculation, so that the calculation can be simplified.

Further, comparing the accumulated luminance with the inputted image data to determine if the accumulated luminance is larger than the inputted image data, as same as FIG. 3, a lighting pattern ON[I] and a carry are generated so as to calculate correction data (S9 to S1).

In addition, differently from FIG. 3, according to the present embodiment, when counting the time slot T, the time slot width ΔT is added.

Thus, by varying the time slot width, another advantage is achieved such that the number of steps for accumulation can be reduced and a clock frequency of the correction circuit can be reduced. In addition, a visual feature of a human being has a tendency that, the lower a tone is for the volume of the luminance, the higher a resolution performance is, and the higher a tone is for the volume of the luminance, the lower a resolution performance is. In consideration of such a point, even from a point of view of an error of correction, when the time step is made uneven, a more excellent advantage can be obtained than the case of calculating the same step number evenly.

In addition, the comparator 104 detects that the accumulated luminance is not less than the inputted image data, however, the present embodiment is not limited to this. For example, it may be detected that the accumulated luminance is larger than the image data, and it may be detected that the accumulated luminance is larger than the image data for a predetermined amount.

Second Embodiment

According to the first embodiment, as shown in FIG. 1, the luminance accumulation circuits 100 are provided corresponding to all modulation signal wirings. On the contrary, according to the present embodiment, the configuration such that the modulation signal wirings are divided into blocks each of which has a plurality of modulation signal wirings to calculate corrected image data will be described. In other words, the corrected image data of the input image data corresponding to the plurality of modulation signal wirings are calculated for each block. More specifically, a configuration is employed below, in which a plurality of pixels to be connected to a common wiring are divided into plural pixel groups, each pixel group including plural pixels. The correction data to be used for obtaining the corrected image data corresponding to the pixels in the pixel group are calculated for each pixel group. In addition, the configuration such that a representative value showing lighting states of plural pixels belonging to a pixel group is used as data for evaluating a signal loss or data for evaluating luminance for each period of time after the signal loss occurs is employed below.

Further, the parts that are not particularly explained in the present embodiment are the same as the first embodiment.

<<Image Display Apparatus>>

Figure 7:
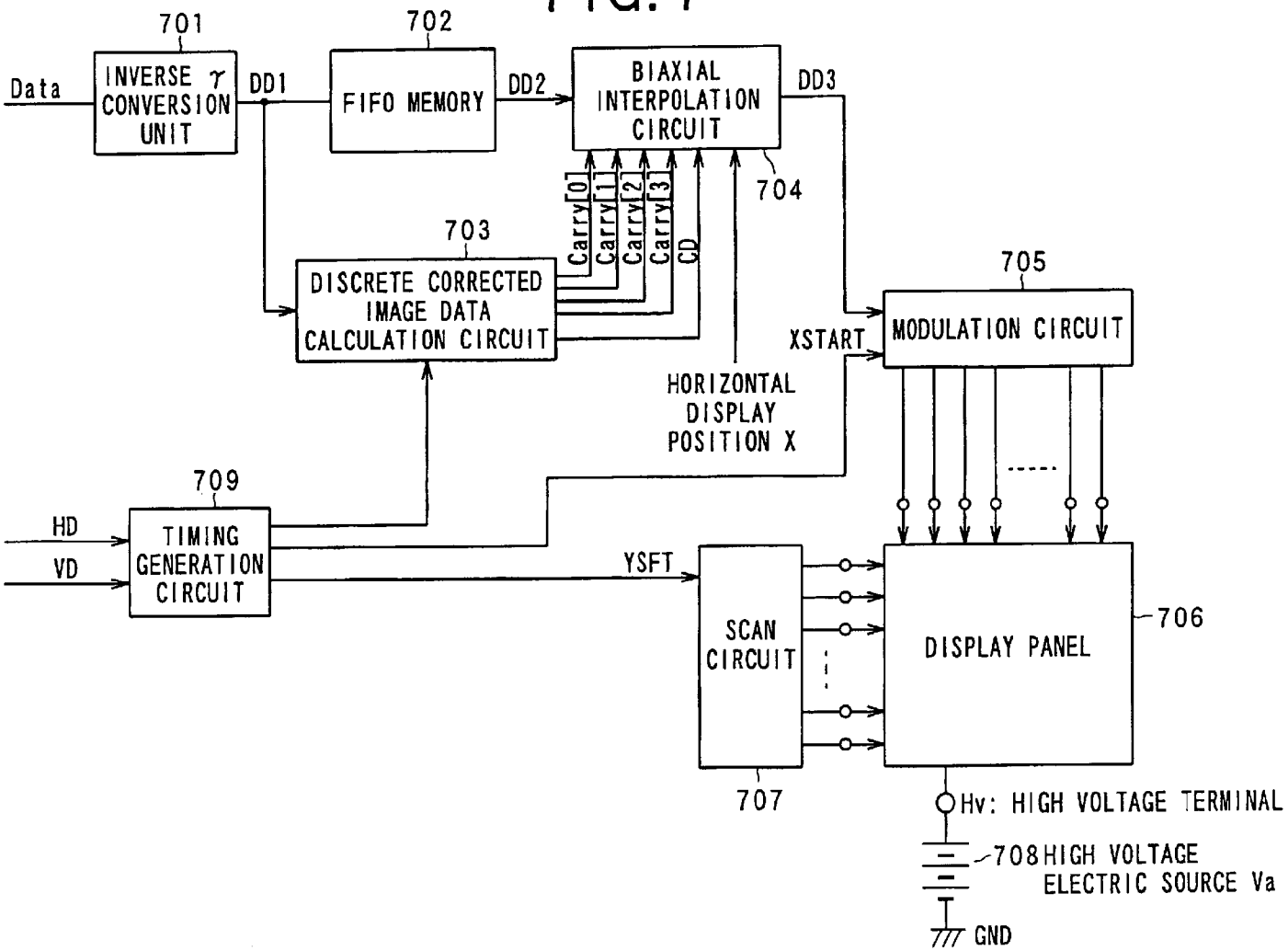
FIG. 7 is a block diagram of the image display apparatus according to the second embodiment.

FIG. 7 is a block diagram of the image display apparatus according to the present embodiment. The image display apparatus includes an inverse y conversion unit 701, a FIFO memory 702, a discrete corrected image data calculation circuit 703, a biaxial interpolation circuit 704, a modulation circuit 705, a display panel 706, a scan circuit 707, a high voltage electric source 708, and a timing generation circuit 709 for synchronizing each part.

The image display apparatus is operated on the basis of a timing signal that is generated in the timing generation circuit 709 with reference to a horizontal synchronization HD and a vertical synchronization VD of image signal.

In the inverse γ conversion unit 701, the image data Data are inputted. For simplification, the image data Data are represented as "Data" in FIG. 7, however, the image data Data correspond to color image signals R, G, and B in color image display apparatus, respectively to be inputted in the inverse γ conversion unit 701 in a point-sequence. The inverse γ conversion unit 701 makes the input image data Data into inverse γ conversion. The inverse γ conversion unit 701 outputs the inverse γ converted image data to the discrete corrected image data calculation circuit 703.

According to the present embodiment, "a plurality of reference positions" are arranged on the scan signal wiring. One pixel group (one block) corresponds to one reference position. In each block, the corrected image data corresponding to the reference position is discretely calculated. Each reference position is equivalent to a position of a modulation signal wiring representing each block when dividing a plurality of modulation signal wirings into blocks. In addition, the discrete corrected image data calculation circuit 703 determines "a plurality of discrete image data reference values (equivalent to a plurality of reference values)" also in a direction of a size (value) of the image data to calculate a discrete corrected image data CD for the image data reference value. The discrete corrected image data calculation circuit 703 outputs the discrete corrected image data CD to the biaxial interpolation circuit 704.

When the discrete corrected image data CD is inputted in the biaxial interpolation circuit 704, the biaxial interpolation circuit 704 interpolates the corrected image data calculated for the discrete reference position and the discrete image data reference value in two axes, namely, in a horizontal direction of a screen and a direction of a size of data. Further, as an interpolation method, any interpolation method can be employed. For example, an example of the interpolation method is described in FIG. 22 of JP-A No. 2003-223131, columns 0210 to 0218 and columns 0290 to 0294 (FIG. 22 of US 2003/0006976 A1, columns [0241] to [0250] and [0332] to [0336]).

The biaxial interpolation circuit calculates corrected image data corresponding to each pixel by carrying out interpolation calculation to be described later with reference to the image data to be transmitted from the FIFO memory 702 and the horizontal display position.

Further, the FIFO memory 702 is provided so as to absorb a calculation time in the discrete corrected image data calculation circuit 703. The image data delayed by the FIFO memory 702 and the corrected image data calculated by the discrete corrected image data calculation circuit 703 are synchronized to be inputted in the biaxial interpolation circuit. Read/Write or the like of the FIFO memory 702 is controlled by a timing signal (not illustrated) from the timing generation circuit 709.

The corrected image data CD that is calculated in this way is inputted in a modulation circuit and a modulation signal is provided to each modulation signal wiring in accordance with the corrected image data.

As described above, with reference to FIG. 7, the entire flow of the signal in the image display apparatus has been explained.

<<Discrete Corrected Image Data Calculation Circuit 703 (Corresponding to "Correction Circuit" of the Present Invention)>>

Figure 6:
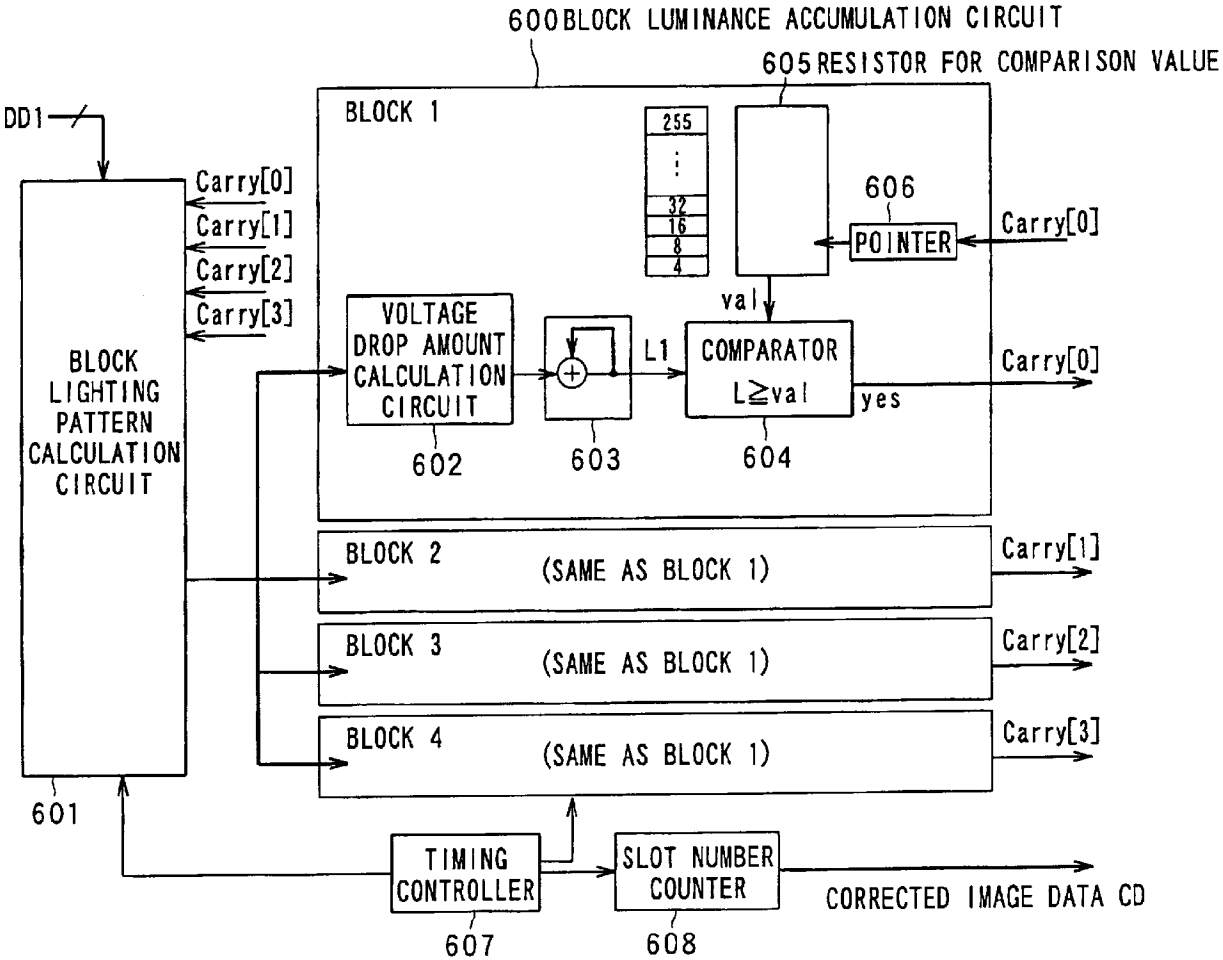
FIG. 6 is a view showing the structure of a discrete corrected image data calculation circuit of an image display apparatus according to a second embodiment.

Next, the discrete corrected image data calculation circuit 703 will be described in detail. FIG. 6 is a view showing the structure of the discrete corrected image data calculation circuit 703 of the image display apparatus according to the present embodiment. The discrete corrected image data calculation circuit 703 includes a block lighting pattern calculation circuit 601, a voltage drop amount calculation circuit 602, an accumulation circuit 603, a comparator 604, a register for a comparison value 605, a pointer 606, a timing controller 607 for synchronizing each part, and a slot number counter 608 for counting the slot number. Further, a block luminance accumulation circuit 600 is formed by the voltage drop amount calculation circuit 602, the accumulation circuit 603, the comparator 604, the register for a comparison value 605, and the pointer 606. In addition, a block in this case is defined to be a group as a bundle of a plurality of modulation signal wirings. According to the present embodiment, a plurality of modulation signal wirings is divided into four blocks. In FIG. 6, the top block luminance accumulation circuit 600 (BLOCK1) is equivalent to a first correction unit. The second top block luminance accumulation circuit (BLOCK2) is equivalent to a second correction unit.

Figure 8:
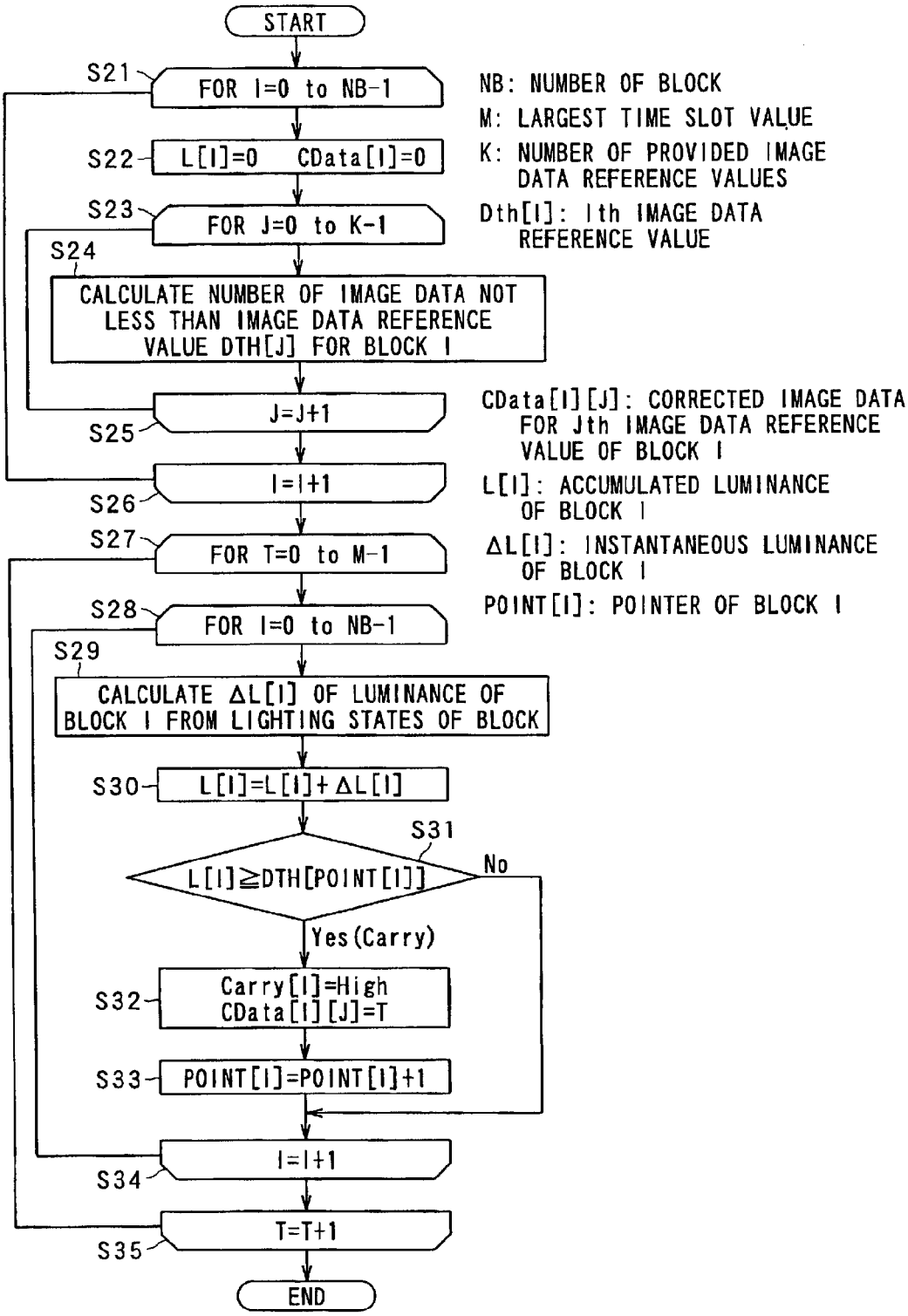
FIG. 8 is a flow chart showing the operation of the discrete corrected image data calculation circuit of the image display apparatus according to the second embodiment.

In addition, FIG. 8 is a flow chart showing the operation of the discrete corrected image data calculation circuit 703 of the image display apparatus according to the present embodiment. The flow chart of FIG. 8 is partially indicated in a sequence processing for convenience of description.

<Block Lighting Pattern Calculation Circuit 601>

Dividing a plurality of pixels to be connected to one scan signal wiring into four blocks and evaluating the lighting state of the pixel in each block, the block lighting pattern calculation circuit 601 sets, for each block, one value reflecting the lighting state of the pixels in the block. According to the first embodiment, a lighting pattern is represented making the lighting state of each pixel into one bit of ON and OFF. In other words, according to the first embodiment, the lighting pattern is represented by the data of the number of pixels×the information indicating the lighting state for each pixel (the number of pixels×1 bit). On the other hand, according to the present embodiment, the lighting pattern is represented by the data of the block number×the information indicating the lighting state for a plurality of pixels in each block. Specifically, according to the present embodiment, the lighting state of each block is represented by a value of three bits in proportion to a lighting ratio of a pixel in a block (a ratio of an ON element in a display device included in the block). In other words, according to the present embodiment, the lighting pattern is represented by the data of the block number×3 bits.

When the image data DD1 for one horizontal scan period of time is inputted, the block lighting pattern calculation circuit 601 analyzes the image data DD1 to calculate a lighting pattern at a point of time of a time slot T=0. When there are NB pieces of blocks, the block lighting pattern calculation circuit 601 creates lighting patterns of respective blocks from the first block 0 up to a block NB−1 on the basis of the image data DD1. In the flow chart of FIG. 8, the number of the image data not less than the data reference value DTH[J] is calculated for NB pieces of blocks from the block 0 up to the block NB−1 (S21 to S26). Further, in step S22, the accumulated luminance value (L[I]) in each block is set at "0" and a value of the corrected image data (CData [I]) for the Jth image data reference value DTH [J] of the block I is set at "0". For each block, K pieces of the image data reference values DTH (K is an integer not less than 1) are set. The number of the image data not less than the image data reference value DTH[J], namely, from the first image data reference value DTH[0] up to the image data reference value DTH[K−1] is calculated. In other words, with reference to the image data, the block lighting pattern calculation circuit 601 calculates a histogram of the image data for each block (S24). In order to obtain a histogram, the block lighting pattern calculation circuit 601 counts a ratio that the modulation signal not less than a reference value of each image data is included for each block and converts it into a value of three bits (0 to 7 in a binary digit). The block lighting pattern calculation circuit 601 outputs a value of a lighting pattern represented by total 12 bits of 4×3 bits to the voltage drop amount calculation circuit 602. FIG. 12 shows an example of a histogram that is calculated for the image data during a certain one horizontal scanning period. Further, the value indicating the lighting state of the pixels in the block is not limited to the lighting ratio of the pixels included in the block but various values such as the number of the lighting pixels, the number of the no-lighting pixels, and the accumulated value of the image data corresponding to the pixels included in the block can be employed.

<Voltage Drop Amount Calculation Circuit 602>

The voltage drop amount calculation circuit 602 calculates luminance ΔL of each block in accordance with the inputted lighting pattern of 12 bits. The voltage drop amount calculation circuit 602 calculates the luminance ΔL as a value of the luminance ΔL (a value showing the luminance of the pixel group) on the reference position on the center of the block when the pixels are not blocked (S29). In other words, the reference position is located on the center of each block. In addition, the value to be calculated from the reference position corresponds to the same spacious position as that in the case that the pixels are not blocked. As same as the first embodiment, in the first period of time, the luminance ΔL based on the lighting pattern decided as described above on the basis of the inputted image data. The updated lighting pattern is calculated on and after the second period of time if the lighting pattern is updated on the basis of the accumulation results of the former luminance ΔL.

According to the present embodiment, as the voltage drop amount calculation circuit 602, a memory having a parameter set in advance is used. Then, if the lighting pattern is inputted, the voltage drop amount calculation circuit 602 outputs the luminance ΔL[I] of that block to the accumulation circuit 603.

For example, if the lighting pattern (7, 7, 7, 7) shown in FIG. 12 is inputted, the voltage drop amount calculation circuit 602 of the block 0 calculates the luminance of the block 0 on the basis of this lighting pattern. Then, the voltage drop amount calculation circuit 602 outputs the luminance of the block 0 to the accumulation circuit 603.

<Accumulation Circuit 603>

The accumulation circuit 603, in synchronization with a timing signal from the timing controller 607 accumulates the luminance ΔL[I] in sequence in accordance with a counting-up of the slot number counter 608 and outputs the accumulated luminance L (corresponding to "an accumulated value obtained by an accumulation" of the present invention) in sequence (S30). The accumulation circuit 603 outputs the accumulated luminance L to the comparator 604. The accumulation circuit 603 accumulates the luminance ΔL of each period of time in sequence. However, since the luminance ΔL corresponding to a pixel becomes 0 after a period of time at which the accumulated value exceeds the image data for the pixel, the accumulation circuit 603 may be configured so as to stop the accumulation with respect to that pixel after that period of time.

<Comparator 604>

The comparator 604 may compare the accumulated luminance L[I] with the image data reference value DTH[POINT [I]] for each timing (S31). The comparator 604 makes Carry [I] into "High" when the accumulated luminance L[I] is not less than the image data reference value DTH[POINT[I]] (Yes) (S31).

If Carry[I] becomes "High", the pointer 606 advances a pointer one and the value of the register for the comparison value 605 is changed one (S33). The image data reference value that is set for the image data is recorded in the register for the comparison value 605 and if the pointer is changed, the next image data reference value is inputted in the comparator. The value of the pointer is reset at a point of time when the accumulation is started and next, the smallest image data reference value is inputted in the comparator 604.

For example, in a comparison value register, an image data reference value "4" is set as an initial value. Then, when the accumulated luminance L[0] of the block 0 becomes larger than the image data reference value "4", Carry[0] is made into "High". If Carry[0] is made into "High", the pointer 606 advances the pointer one. Then, the register for the comparison value 605 sets the image data reference value at "8" (S33). In addition, if Carry[0] is made into "High", the lighting patter is made into "6, 7, 7, 7". Further, by advancing the pointer one, a value val to be outputted by the comparison value register is updated, so that Carry[0] is made into "low".

Further, a point of time when Carry of one block is made into High indicates that the corrected image data for the image data reference value that is a comparison target at that point of time is a count value of the slot number counter at that point of time. In the case that there is a pixel having the same image data as the image data reference value that is a comparison target in the block, this corrected image data will be used as the corrected image data for its pixel.

In addition, a Carry signal of each block is feed-backed to the block lighting pattern calculation circuit and in accordance with this, the block lighting pattern is updated in sequence.

At a point of time when a Carry signal is made into High, a lighting pattern of a block that its Carry is made into High moves into a lighting state for a next image data reference value.

According to the present embodiment, by repeating such operation, the corrected image data for the discrete image data reference value for each block can be calculated. In other words, the lighting state for each block is updated by a determination result by the comparator and in accordance with the updated lighting state, subsequent calculations are carried out.

Further, according to the present embodiment, the reference value to be compared with the value obtained by the accumulation is defined as a discrete value such as 4, 8, 16, . . . . Then, the present embodiment is configured so as to obtain the corrected image data corresponding to each reference value. On the other hand, the configuration may be employed, in which all values (1, 2, 3, . . . 255) that can be obtained by the image data are defined as a reference value, respectively. In this case, the interpolation in the direction of the size of the image data to be described later is not needed.

The corrected image data that has been calculated in this way is inputted in the biaxial interpolation circuit 704, the interpolation is carried out in accordance with the image data and a horizontal position (a number of a modulation signal wiring) of a screen, and then, the corrected image data in accordance with each of them is calculated.

<Biaxial Interpolation Circuit 704>

Figure 10:
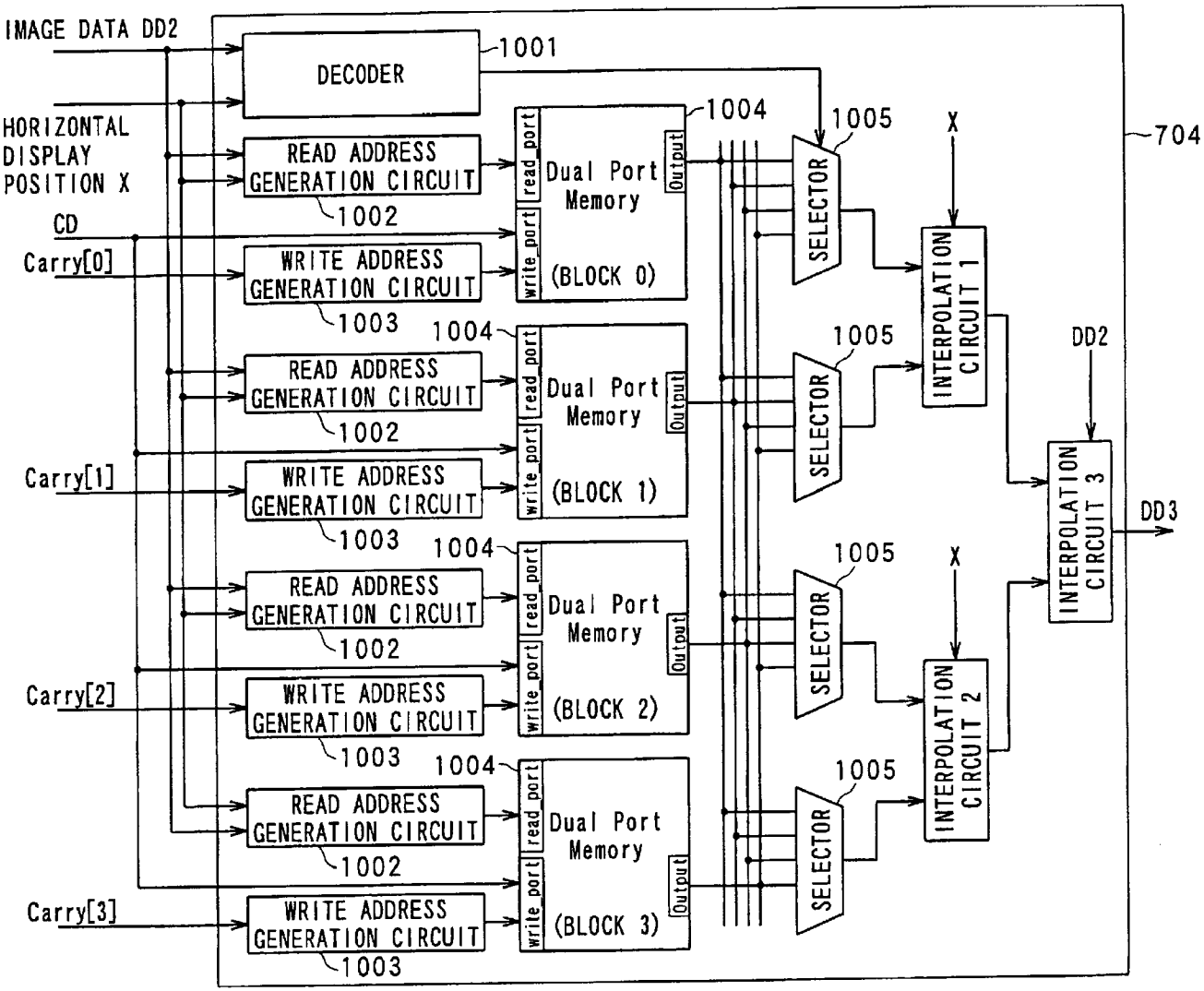
FIG. 10 is a biaxial interpolation circuit that is used in the second embodiment.

FIG. 10 is a view for explaining the biaxial interpolation circuit 704 according to the present embodiment. The present embodiment is configured so as to obtain the corrected image data in accordance with a value (a reference value) within a value that can be obtained by the image data for each pixel group. Accordingly, the corrected image data corresponding to the image data of the value other than the reference value is obtained by interpolation. In addition, interpolation in accordance with the position of the pixel is also carried out. As the interpolation processing to be made here, various interpolation processing can be employed, however, the following preferable configurations are shown.

The biaxial interpolation circuit includes: a decoder 1001; read address generation circuits 1002, write address generation circuits 1003, and Dual Port memories 1004 which respectively corresponds to blocks; selectors 1005; and interpolation circuits 1, 2, and 3.

At first, the transfer sequence of the correction data from the discrete corrected image data calculation circuit 703 to the biaxial interpolation circuit 704 will be described.

During each horizontal scan period, in the biaxial interpolation circuit 704, a time slot value (CD) from the discrete corrected image data calculation circuit 703 and a Carry signal [I] for each block are provided in chronologic order. The write address generation circuit 1003 counts the number of carry signals from start of 1H. Counting-up an address for writing in sequence from 0 at timing when the signal becomes Carry, and using a time slot value CD in that case as the data for writing, the correction data of its block is written in the Dual Port memory 1004. Since Carry is made into High whenever the luminance of the block attains to an image data reference value, the correction value for the each image date reference value of the block will be stored in the Dual Port memory 1004.

Next, a sequence to calculate the corrected image data DD3 by reading the data written in the Dual Port memory 1004 and carrying out interpolation will be described.

During each horizontal scan period, the image data DD2 and a horizontal display position X are inputted in the biaxial interpolation circuit 704. In the read address generation circuit 1002, with reference to the size of the image data and the value of the horizontal display position X, an address for reading the data from the Dual Port memory 1004 is generated.

The decoder 1001 is a circuit for switching the selectors 1005 with reference to the size of the image data and the value of the horizontal display position x. The selector 1005 further switches the value read from the Dual Port memory 1004 and provides this value to interpolation circuits 1 and 2 on a next stage.

At first, the interpolation circuits 1 and 2 are circuits to interpolate the corrected image data for each block in accordance with the horizontal display position x of the screen.

The interpolation circuit 3 calculates the corrected image data DD3 by interpolating the results calculated by the interpolation circuits 1 and 2 in a direction of the size of the image data.

FIG. 11 is a view for explaining a process when carrying out an interpolation calculation of the biaxial interpolation circuit 704.

At first, it is assumed that the correction value for the image data reference value DTH[i] (i=0, 1, 2, . . . N) for each block (0 to 3) is stored in the Dual Port memory 1004.

Figure 11A:
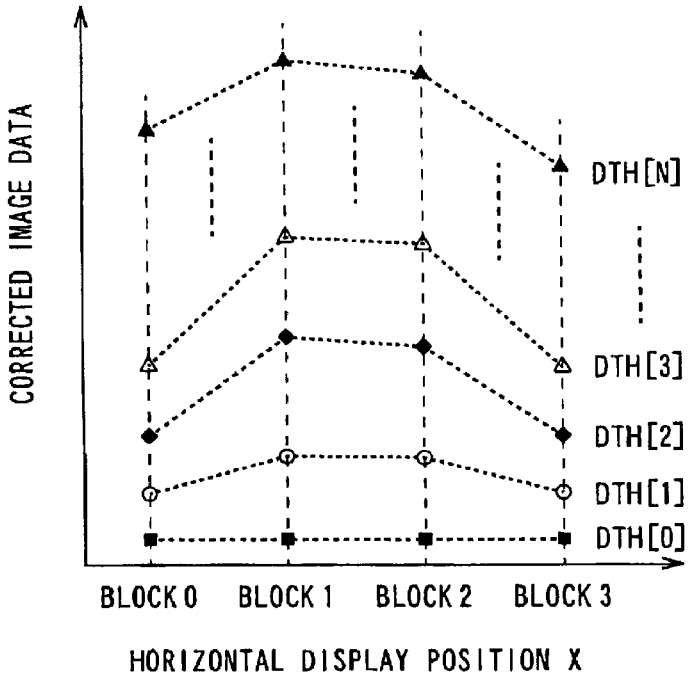
FIG. 11A and FIG. 11B are views for explaining a process when carrying out an interpolation calculation of the biaxial interpolation circuit that is used in the second embodiment.

The correction value stored in the Dual Port memory 1004 corresponds to portions represented by marks such as a white circle, a white triangle, a black triangle, a black rhombus, and a black rectangle in FIG. 11A. No data between the correction values is stored.

Next, when the image data DD2 and the horizontal display position X are inputted, four correction values CA, CB, CC, and CD are selected from among these stored correction values.

For the horizontal display position x and the image data DD2, four correction values are selected as CA: a correction value for a block n and an image data reference value DTH[k], CB: the correction value for a block n+1 and the image data reference value DTH[k], CC: the correction value for the block n and the image data reference value DTH[k+1], and CD: the correction value for a block n+1 and the image data reference value DTH[k+1], where n is a number of block, satisfying $$Xn \leqq x \leqq Xn+1$$

(Xn represents a horizontal display position corresponding to the nth block), and k is a number of an image data reference value, satisfying $$DTH[k] \leqq DD2 < DTH[k+1]$$

(DTH[k] represents the kth image data reference value).

Next, the interpolation calculation is carried out for the selected correction values CA, CB, CC, and CD corresponding to the size of the real image data and the horizontal display position by the interpolation circuits 1 to 3.

At first, as the interpolation for the horizontal display position, C1 is calculated from CA and CB by the interpolation circuit 1 as the interpolation for the horizontal display position. In the same way, C2 is calculated from CC and CD.

Figure 11B:
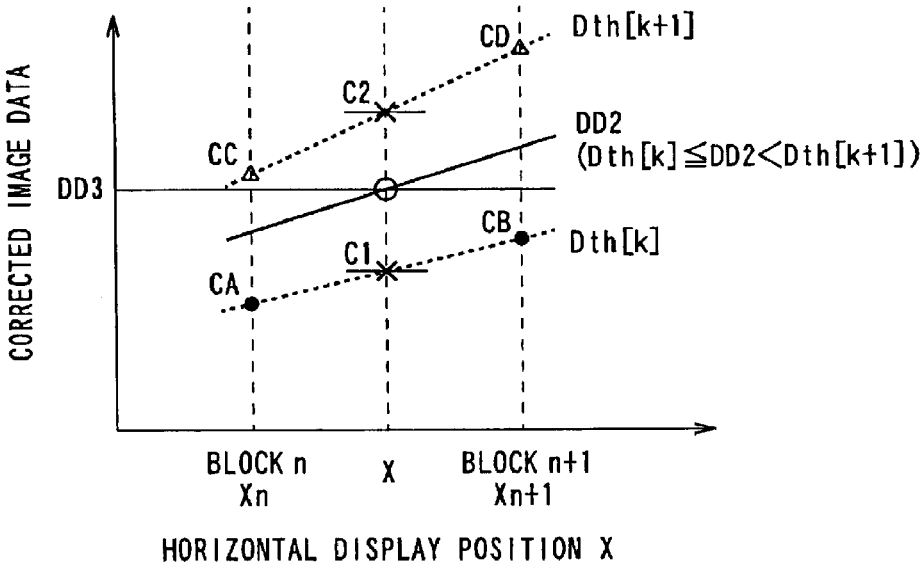

Next, as the interpolation for the size of the image data, corrected image data DD3 is calculated from c1 and c2 by the interpolation circuit 3 (FIG. 11B shows a calculation formula in the case of a linear approximation).

Calculating the corrected image data in this way, the calculation amount is reduced more largely than the configuration of the first embodiment, so that the hardware amount is also largely reduced.

Further, checking an advantage of correction, although an error for carrying out interpolation for the configuration of the first embodiment is generated, the error of the correction that is an object of the present invention is reduced, so that the image can be displayed very preferably.

Further, according to the present embodiment, discretization is simultaneously carried out for the horizontal direction of the screen and the size of the image data, however, the present embodiment is not limited to this and for example, discretization may be carried out only in the direction of the size of the image data or only in the horizontal direction of the screen.

In addition, according to the present embodiment, the luminance is accumulated in a time direction, however, its time slot width is not necessarily even. As a time passes, the time slot width may be changed. For example, a short time slot width may be set in a portion having a small time slot corresponding to a low tone and a long time slot width may be set in a portion having a large time slot corresponding to a high tone. However, when the time slot width is changed in this way, upon accumulation of luminance, it is necessary to carry out accumulation in accordance with this time slot width and it is necessary to change the time slot width in accordance with this upon counting-up of the slot number counter. By changing the time slot width in this way, there is another advantage such that the number of steps for carrying out accumulation can be reduced and the clock frequency of the correction circuit can be reduced.

In addition, by setting the value of the image data reference value to be set for the size of the image data not at a predetermined interval but at an uneven pitch, the number of the corrected image data to be referred by the interpolation circuit is decreased and this leads to simplification of a circuit.

In this case, by setting a low tone part requiring a degree of accuracy at a fine pitch and a high tone part at a rough pitch, without lowering the degree of accuracy of the correction, it is possible to decrease the circuit amount.

In addition, a visual feature of a human being has a tendency that, the lower a tone is, the higher a resolution performance is and the higher a tone is, the lower a resolution performance is with respect to the volume of the luminance. In consideration of such a point, even from a point of view of an error of correction, when the time step is made uneven, a more excellent advantage can be obtained than the case of calculating the same step number evenly.

As same as the first embodiment, the comparator detects that the accumulated luminance takes a value not less than the image data reference value, however, the present embodiment is not limited to this in a precise sense. In other words, the comparator may detect that the accumulated luminance is larger than the image data reference value or may detect that the accumulated luminance is larger than the image data by a predetermined amount (in this case, although an error is increased, there is an advantage to some extent as correction).

In addition, according to each of the above-described embodiments, as a signal loss, an example to compensate a loss due to a voltage drop on a common wiring is cited. In addition to this compensation, a correction to compensate a signal loss on a modulation signal wiring may be carried out. Further, the compensation in the present application is not limited to that to completely compensate the loss in just proportion and it is enough to prevent deterioration of an image quality due to the loss.

Third Embodiment

According to the first and second embodiments, the correction circuit and the image display apparatus according to the present invention have been described.

According to the above-described embodiments, in consideration of the amount of the luminance that is lowered due to the influence of the voltage drop, the size of the image data is corrected for input in a direction to compensate the shortage.

Although the size of the image data generally has one upper limit, in order to carry out the correction preferably, it is necessary to control the corrected image data so as to be in the range of the upper limit.

The inventor(s) has already disclosed such an art in JP-A No. 2003-233344 (US 2003/0030654 A1). Therefore, by combining this art with the present invention, not only the correction can be preferably carried out but also control of the size of the image data can be preferably carried out.

Fourth Embodiment

As the configuration to preferably display an image in the image display apparatus using the surface conduction electron-emitting device, some corrections are proposed.

JP-A No. 2005-031636 (US 2004/0257311 A1) is the configuration so as to decrease a visual feature by the halation of the image display apparatus.

In addition, JP-A No. 07-181911 (U.S. Pat. No. 5,659,328) discloses the configuration so as to correct a uniformity of the display apparatus.

The inventor(s) of the present invention has confirmed that a more preferable display can be realized by combining the corrections of the present invention.

In this case, according to a sequence of correction, at first, halation of the image data that is inverse γ corrected is corrected, and after that, correction about uniformity is carried out. Then, applying the correction of the voltage drop of the present invention to this image data, it is possible to display a preferable image.

Further, in the case that a light emission property of a phosphor has non-linearity to driving, by providing a table to cancel the non-linearity before the correction of the voltage drop or providing a table to cancel the non-linearity after the correction of the voltage drop, it is possible to preferably display an image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-335839, filed on Dec. 13, 2006, which is hereby incorporated by reference herein in its entirety.

This application claims the benefit of Japanese Patent Application No. 2007-312167, filed on Dec. 3, 2007, which is hereby incorporated by reference herein in its entirety.

What is claimed is:

1. An image display apparatus comprising:

a plurality of pixels;

a common wiring to which a first set of pixels are connected in common;

a plurality of modulation signal wirings, each of which is connected to a set of pixels, and applying a modulation signal for modulating a lighting time to the plurality of pixels;

a correction circuit for correcting inputted data and outputting the corrected data; and a modulation signal output circuit for outputting the modulation signal on the basis of the data that is corrected by the correction circuit, wherein when M pieces of periods in a period that the modulation signal can be outputted are referred to as first to Mth periods, where M is defined to be a natural number and p is defined to be a natural number in $2 \leqq p \leqq M$, the correction circuit has:

a calculation unit for calculating a value representing luminance during a first period of each of the plurality of pixels on the basis of the inputted data and calculating a value representing luminance during a pth period in sequence; and an accumulation unit for accumulating the value representing the luminance during each period for each pixel; and wherein on the basis of a result of determining a pixel that the accumulated value thereof exceeds a value representing luminance that is indicated by the inputted data thereof, a value representing the luminance during the pth period is calculated.

2. A driving method of an image display apparatus, the image display apparatus, having:

a plurality of pixels;

a common wiring to which a first set of pixels are connected in common;

a plurality of modulation signal wirings, each of which is connected to a set of pixels, and applying a modulation signal for modulating a lighting time to the plurality of pixels;

the driving method comprising:

a correcting step for correcting inputted data; and a step of outputting the modulation signal on the basis of the data that is corrected by the correction step, wherein when M pieces of periods in a period that the modulation signal can be outputted are referred to as first to Mth periods, where M is defined to be a natural number and p is defined to be a natural number in $2 \leqq p \leqq M$, the correction step includes:

a step for calculating a value representing luminance during a first period of each of the plurality of pixels on the basis of the inputted data;

a step for calculating a value representing luminance during a pth period of each of the plurality of pixels in sequence; and a step for accumulating the value representing the luminance during each period for each pixel, wherein, on the basis of a result of determining a pixel that the accumulated value thereof exceeds a value representing luminance that is indicated by the inputted data thereof, a value representing the luminance during the pth period is calculated.

3. An image display apparatus comprising:

a first pixel group including a plurality of pixels and a second pixel group including a plurality of pixels;

a common wiring to which of pixels of the first pixel group and pixels of the second pixel group are connected in common;

a plurality of modulation signal wirings, each of which is connected to pixels of the first pixel group and pixels of the second pixel group, and applying a modulation signal for modulating a lighting time to the pixels;

a first correction unit for outputting data to determine the lighting time of the pixels belonging to the first pixel group by carrying out calculation on the basis of a value representing a lighting state of the plurality of pixels of the first pixel group and a value representing a lighting state of the plurality of pixels of the second pixel group;

a second correction unit for outputting data to determine the lighting time of the pixels belonging to the second pixel group by carrying out calculation on the basis of a value representing a lighting state of the plurality of pixels of the first pixel group and a value representing a lighting state of the plurality of pixels of the second pixel group; and a modulation signal output circuit for outputting the modulation signal on the basis of the outputted data to determine the lighting time, wherein the second correction unit uses the a value that is updated on the basis of the calculation by the first correction unit, as the value representing the lighting state of the plurality of pixels of the first pixel group.

4. An image display apparatus according to claim 3, wherein interpolation calculation using the data outputted from the first correction unit or the second correction unit is carried out.

5. An image display apparatus according to claim 3, wherein the first correction unit outputs the data to determine the lighting time of the pixels belonging to the first pixel group with respect to each of a plurality of different reference values; and the second correction unit outputs the data to determine the lighting time of the pixels belonging to the second pixel group with respect to each of a plurality of different reference values.

6. An image display apparatus according to claim 5, wherein interpolation calculation on the basis of a value of data to indicate luminance of a predetermined pixel belonging to the first pixel group is carried out by using a plurality of data outputted from the first correction unit with respect to the plurality of reference values.

7. An image display apparatus according to claim 3, wherein interpolation calculation in accordance with a position of a pixel is carried out by using a plurality of data outputted from the first correction unit and the second correction unit.

8. An image display apparatus according to claim 3, wherein the first correction unit and the second correction unit output the data to which correction to compensate a signal loss of the common wiring is applied.

9. A driving method of an image display apparatus, the image display apparatus having:

a first pixel group including a plurality of pixels and a second pixel group including a plurality of pixels;

a common wiring to which pixels of the first pixel group and pixels of the second pixel group are connected in common; and a plurality of modulation signal wirings, each of which is connected to pixels of the first pixel group and pixels of the second pixel group, and applying a modulation signal for modulating a lighting time to the pixels;

the driving method comprising the steps of:

deciding the data to determine the lighting time of pixels belonging to the first pixel group on the basis of a value representing a lighting state of the plurality of pixels of the first pixel group and a value representing a lighting state of the plurality of pixels of the second pixel group;

deciding the data to determine the lighting time of pixels belonging to the second pixel group on the basis of a value representing a lighting state of the plurality of pixels of the first pixel group and a value representing a lighting state of the plurality of pixels of the second pixel group; and outputting the modulation signal on the basis of the decided data to determine the lighting time, wherein when deciding the data to determine the lighting time of the pixels belonging to the second pixel group, as the value representing the lighting state of the plurality of pixels of the first pixel group, a value that is updated on the basis of the calculation to decide the data to determine the lighting time of the pixels belonging to the first pixel group is used.

10. An image display apparatus comprising:

a plurality of pixel groups each including a plurality of pixels;

a common wiring to which a plurality of pixels are connected in common;

a plurality of modulation signal wirings, each of which is connected to pixels belonging to the plurality of pixel groups, and applying a modulation signal for modulating a lighting time to the pixels;

a correction circuit for correcting inputted data and outputting the corrected data; and a modulation signal output circuit for outputting the modulation signal on the basis of the data that is corrected by the correction circuit, wherein when M pieces of periods in a period that the modulation signal can be outputted are referred to as first to Mth periods, where M is defined to be a natural number and p is defined to be a natural number in $2 \leqq p \leqq M$, the correction circuit has:

a calculation unit for calculating a value representing luminance during a first period of each of the plurality of pixel groups on the basis of the inputted data and calculating a value representing luminance during a pth period in sequence; and an accumulation unit for accumulating the value representing the luminance during each period for each pixel, and wherein on the basis of a result of determining a pixel group that the accumulated value thereof exceeds a predetermined value, a value representing the luminance during the pth period is calculated.

11. An image display apparatus according to claim 10, wherein the correction circuit outputs the data on the basis of a value of q when the accumulated value from the first period to the (q−1)th period (q is a natural number in $2 \leqq p \leqq M$) does not exceed the predetermined value and the accumulated value from the first period to the qth period exceeds the predetermined value.

12. A driving method of an image display apparatus, the image display apparatus having:

a plurality of pixel groups each including a plurality of pixels;

a common wiring to which a plurality of pixels are connected in common; and a plurality of modulation signal wirings, each of which is connected to pixels belonging to the plurality of pixel groups, and applying a modulation signal for modulating the lighting time to the pixels;

the driving method comprising:

a correcting step for correcting inputted data; and a step of outputting the modulation signal on the basis of the data that is corrected by the correction step, wherein when M pieces of periods in a period that the modulation signal can be outputted are referred to as first to Mth periods, where M is defined to be a natural number and p is defined to be a natural number in $2 \leqq p \leqq M$, the correction step includes:

a step for calculating a value representing luminance during a first period of each of the plurality of pixel groups on the basis of the inputted data;

a step for calculating a value representing luminance during a pth period of each of the plurality of pixel groups in sequence; and a step for accumulating the value representing the luminance during each period for each pixel group, wherein, on the basis of a result of determining a pixel group that the accumulated value thereof exceeds a predetermined value, a value representing the luminance during the pth period is calculated.

* * * * *